US010912363B1

(12) United States Patent
Kanter

(10) Patent No.: US 10,912,363 B1
(45) Date of Patent: Feb. 9, 2021

(54) HAIR TREATMENT DEVICE FOR COLORING HAIR

(71) Applicant: Bruce S. Kanter, Woodland Hills, CA (US)

(72) Inventor: Bruce S. Kanter, Woodland Hills, CA (US)

( * ) Notice: Subject to any disclaimer, the term of this patent is extended or adjusted under 35 U.S.C. 154(b) by 462 days.

(21) Appl. No.: 14/847,758

(22) Filed: Sep. 8, 2015

Related U.S. Application Data

(60) Provisional application No. 62/046,473, filed on Sep. 5, 2014.

(51) Int. Cl.

| | |
|---|---|
| ***A45D 7/00*** | (2006.01) |
| ***A45D 19/00*** | (2006.01) |
| ***A45D 1/06*** | (2006.01) |
| *A45D 1/04* | (2006.01) |

(52) U.S. Cl.
CPC ..... *A45D 19/0008* (2013.01); *A45D 1/06* (2013.01); *A45D 1/04* (2013.01); *A45D 2007/001* (2013.01); *A45D 2019/0066* (2013.01); *A45D 2019/0091* (2013.01)

(58) Field of Classification Search
CPC .. A45D 2007/001; A45D 7/065; A45D 7/045; A45D 19/0008; A45D 2019/0066; A45D 2019/0091; A45D 1/04; A45D 1/06; A45D 1/02; A45D 1/08; A45D 2001/008; A45D 2/001
USPC ..... 132/208
See application file for complete search history.

(56) References Cited

U.S. PATENT DOCUMENTS 3,861,405 A * 1/1975 Pellecchia ..... A45D 19/0025 132/270
4,483,354 A * 11/1984 Marcotte ..... A45D 24/36 132/213
5,137,715 A * 8/1992 Hoshowski ..... A61K 8/463 424/70.17
5,472,688 A * 12/1995 Soukup ..... A61K 8/19 424/630

(Continued)

FOREIGN PATENT DOCUMENTS

| | | |
|---|---|---|
| WO | 2010017585 | 2/2010 |
| WO | 2012171066 | 12/2012 |
| WO | 2013140073 | 9/2013 |

OTHER PUBLICATIONS

LongHair Care Forum, Aluminum Foil for Flat Ironing, https://longhaircareforum.com/threads/aluminum-foil-for-flat-ironing.440452/, Jan. 31, 2010, pp. 1-9.*

(Continued)

*Primary Examiner* — Tatiana L Nobrega
(74) *Attorney, Agent, or Firm* — Taft Stettinius & Hollister, LLP; Audrey J. Babcock

(57) ABSTRACT

A hair treatment device for use in the application of direct heat to foil-covered sections of hair, in order to accelerate a hair highlighting or hair coloring process, is described. The hair treatment device includes two opposing plates for transmitting heat. The foil-covered sections of hair are pressed between the opposing plates when the device is in use. The plates are set in a housing. Seals are located along edges of the plates, edges of the housing, or both, in order to protect the user's scalp from the heated plates. A plurality of venting passages pass through the plates.

21 Claims, 20 Drawing Sheets

(56) References Cited

U.S. PATENT DOCUMENTS 5,860,431 A * 1/1999 Abercrombie ..... A45D 19/0025 132/208
5,983,903 A 11/1999 Nanba et al.
6,022,380 A 2/2000 Satoh
6,129,770 A * 10/2000 Deutz ..... A61K 8/42 8/405
6,622,735 B2 9/2003 Hirata et al.
6,941,955 B2 * 9/2005 Yao ..... A45D 1/04 132/225
7,445,012 B2 11/2008 Mukai
7,981,167 B2 * 7/2011 Carballada ..... A61K 8/44 8/405
8,082,929 B2 12/2011 Kim
8,124,914 B2 * 2/2012 Yu ..... A45D 1/04 219/225
8,129,661 B2 3/2012 Catini
2004/0118424 A1 * 6/2004 Russell ..... A61K 8/0208 132/208
2005/0180941 A1 * 8/2005 Doi ..... A61K 8/41 424/70.27
2006/0201527 A1 9/2006 Higgins et al.
2008/0148496 A1 * 6/2008 Plos ..... A61K 8/40 8/426
2008/0168608 A1 * 7/2008 Plos ..... A61K 8/731 8/405
2009/0084396 A1 4/2009 Jerome et al.
2010/0224206 A1 9/2010 Serresvives et al.
2011/0232673 A1 9/2011 Crawford
2012/0073592 A1 * 3/2012 Koenig ..... A41G 5/0046 132/201
2012/0111355 A1 5/2012 Vacheron et al.
2012/0111356 A1 5/2012 Vacheron et al.
2013/0152958 A1 6/2013 Lee
2013/0192625 A1 8/2013 Migliori et al.
2013/0220358 A1 * 8/2013 Agostino ..... A61K 8/731 132/208
2014/0261520 A1 * 9/2014 Parrish ..... A45D 19/0008 132/208
2014/0290689 A1 * 10/2014 Sutton ..... A61Q 5/065 132/208
2015/0053231 A1 * 2/2015 Bonauer ..... A45D 19/0008 132/208
2015/0101129 A1 * 4/2015 Schmenger ..... A61K 8/55 8/406
2015/0283053 A1 * 10/2015 Odman Schmid ..... A61K 8/31 8/416
2016/0262519 A1 * 9/2016 Zhang ..... A45D 6/00

OTHER PUBLICATIONS

Aliexpress.com, "Manufacturers selling arrow WangZhi roll amphibious straightening irons and curling iron to splint concave and convex chamfer is" http://www.aliexpress.com/item/Manufacturers-selling-arrow-WangZhi-roll-amphibious-straightening-irons-and-curling-iron-to-splint-concave-and-convex/502222473.html, Mar. 27, 2014.

amazon.com, Remington S7210 Wet 2 Straight Flat Iron with Soy Hydra Complex, http://www.amazon.com/Remington-S7230-Straight-Hydra-Complex/dp/B009HKAWFC/ref=cm_cr_pr_product_top, Mar. 27, 2014.

ti-style.com, Touch 2 Black Titanium Flat Iron by Ti-Style, http://www.ti-style.com/products/touch-2-black-titanium-flat-iron-by-ti-creative-styling, Mar. 27, 2014.

Conair.com, Our Best Selling Hair Straighteners / Flat Irons, http://www.conair.com/hair-straighteners-flat-irons-c-1_73_12.html, Mar. 27, 2014.

* cited by examiner

HAIR TREATMENT DEVICE FOR COLORING HAIR

RELATED APPLICATIONS

This application claims the benefit of U.S. Provisional Application No. 62/046,473, filed Sep. 5, 2014, which is hereby incorporated by reference in its entirety.

TECHNICAL FIELD

The present invention relates to a hair treatment device, or hair treatment iron, for use in the application of direct heat in order to accelerate a hair highlighting or hair coloring process.

BACKGROUND OF THE INVENTION

There are two approaches to lightening hair. The first approach is to bleach the hair. This is a progressive process that continually lightens hair until the bleach is washed out of the hair, like the process of bleaching clothes. There is no way to control the tonality of the final hair color, often leaving the hair with an undesirable tone.

The second approach to coloring hair is to lighten hair using a hair color product. This is not a progressive process. Hair color products have limits that will only allow them to lighten or deposit color to a certain extent. Hair color products also contain color accent dyes that will promote the color to a more desirable tone. However, hair color products will not lighten previously colored hair effectively because previously colored hair is much more resistant to lightening than natural or "virgin" hair that has never been colored. Because of this resistance to lightening, most hair lightening over previously colored hair has been done using bleach. Without the use of bleach, previously colored hair can only be lightened approximately ½ to 1 level.

There are disadvantages to using bleach on hair. If bleach contacts the hair for too long, it can damage the hair, leading to dry and brittle hair and/or hair breakage. Also, bleached hair can have a brassy appearance.

To avoid the disadvantages of bleach, a hair color product can be used instead of bleach to color and/or highlight hair. Hair color products are generally less harmful to the hair than bleach, and produce a more desirable tone with a less brassy appearance. The accent tones that are present in hair color products allow the hairdresser/colorist to control the lightening process to produce a more attractive tone. Ultimately, hair color products would offer a better result than bleach, if one were able to use hair color products to lighten previously colored hair up to the desired shade in a short amount of time.

Hair which includes highlights is often preferred to monochromatic hair. Hair may be highlighted using the two different approaches outlined above, which are the use of bleach and the use of hair color products. However, as outlined above, there are drawbacks to both of these approaches. Another disadvantage of current methods of highlighting hair is the amount of time required to complete the process. To give highlighted hair a tint, hair is often bleached first to strip out the color, and then a hair color product is applied to the bleached hair in order to give the highlighted hair the desired tone. Therefore, it may require the application of two different products sequentially to achieve the desired result. Even if only a hair color product is used on hair, the highlighting process is time-consuming due to the processing time required. In a typical hair color product, hydrogen peroxide first reacts with melanin in the hair, removing the color, and permanent hair color is then deposited onto the hair, with ammonia acting as a catalyst to activate the coloring elements. Because heat facilitates the highlighting process, heat from a dryer or heat lamp is directed to the hair during the process, as a means of applying indirect heat to the hair. A typical highlighting process usually requires approximately 20 to 40 minutes of processing time after the application of the hair color product.

An additional disadvantage of current highlighting methods is the possibility of different portions of hair completing the highlighting process at different times. Hair is highlighted by selecting strands of a section of hair to place in a foil, applying a highlighting agent (i.e., bleach or a hair color product) to those strands of hair, and then folding the foil. The colorist then proceeds to the next portion of the subject's hair and repeats this process many times in order to add highlights to the entire head of hair. Therefore, the highlighting agent is not applied to the entire head of hair at the same time. Because the highlighting agent is added to different sections of hair at different times, some sections of the client's hair may complete the highlighting process sooner than other sections. For hair that is thick and long, such as hair to which a weave has been added, by the time the foils are completed on one side of the head, the foils on the other side of the head may be ready to be removed. In some circumstances, some sections of hair may even need to be rinsed before the foils are ready to be removed from another part of the head.

Heat is frequently applied to hair during the highlighting process in order to reduce processing times. The typical method of applying heat during the highlighting process is to place the client under a hooded dryer, which directs indirect heat to the hair. Because a dryer provides an indirect application of heat, it generally requires approximately 20 to 40 minutes of processing time to highlight hair. Also, a dryer does not enable a colorist to use targeted heat treatment, in that it does not allow a colorist to select certain sections of hair for greater heat treatment than other sections. Therefore, the colorist's control of the application of the indirect heat is very limited. Accordingly, the use of a dryer in conjunction with highlighting does not alleviate the potential problem of different sections of hair completing the highlighting process at different times.

Devices used for applying heat directly to hair for hair treatment processes, through the direct contact of hair with a heated instrument, are shown in U.S. Patent Application Publication Nos. 2013/0152958 and 2010/0224206, and U.S. Pat. No. 8,124,914. These devices are designed to apply heat directly to hair, rather than to hair which is in a foil packet for highlighting. Therefore, these devices are not designed for use in highlighting hair. Highlighting requires the selection of strands of hair for highlighting. The selected strands of hair must be isolated from neighboring strands to prevent the unwanted bleeding of color to the neighboring strands. Folding foils around the selected strands of hair, such that the selected strands are contained in foil packets during the highlighting process, is an effective way to isolate the selected strands of hair. The foils restrict the highlighting agent to the selected strands of hair, because the foil prevents the highlighting agent from contacting the non-selected neighboring strands. Accordingly, in order for a device which applies heat to hair to be effective for use in a highlighting process, it must be able to treat hair in conjunction with the use of foil packets.

Therefore, a need exists for a hair treatment device that can be used to highlight hair with direct heat, and which can facilitate the use of hair color products to lighten previously colored hair effectively without the use or need for bleach. A need also exists for a hair treatment device which decreases the highlighting processing time. Further, a need exists for a hair treatment device which allows a colorist direct control over the amount of heat applied to different sections of hair, thereby enabling all sections of a client's hair which are contained in foil packets to complete the highlighting process at the same time.

SUMMARY OF THE INVENTION

The present invention is directed to a hair treatment device, or hair treatment iron, designed to be used by hairdressers, colorists, and other hair styling professionals to assist in the process of highlighting hair. The hair treatment iron is preferably used to highlight hair using hair color products, rather than bleach. The hair color product is preferably mixed shortly before the application of the hair color product to the hair. After the colorist applies hair color product and foils to the hair, such that strands of hair are enclosed in foil packets, the hair treatment iron is closed on the foil packets of hair sequentially. In other words, the hair treatment iron is closed on one foil packet for a brief period of time, then another, etc., until all foil packets of hair are treated with heat which emanates from the iron. Preferably, the hair treatment iron is closed on a foil packet for a measured amount of time, wherein the amount of time is selected based on the desired result and based on the length of time the hair has been in contact with the hair color product.

When the hair treatment iron of the present invention is closed on a foil packet of hair, the foil packet is pressed between two opposing metal plates or blades of the iron, similar to the way in which hair is pressed by a curling iron or straightening iron. The hair treatment iron delivers controlled and direct heat to the foil-covered hair to create the highlighted result in a concentrated and rapid manner. Because the hair treatment iron delivers heat directly to the foil-covered hair in a concentrated manner shortly after the application of hair color product to the hair, it speeds the color application process during the time when the coloring agents of the hair color product are at their greatest effectiveness. The application of direct heat during the earliest stages of the newly mixed hair color product allows the hair to be lightened by a greater amount, without the use of bleach, than is possible using traditional processes. Therefore, use of the hair treatment iron allows both previously colored hair and natural hair to be lightened to a greater extent, and to a more desired tone, than is possible using traditional processes. There are 12 levels in the color spectrum, ranging from level 1, which is black, to level 12, which is pale yellow. While traditional processes only allow previously colored hair to be lightened by up to approximately 1 level without the use of bleach, the hair treatment iron of the present invention allows previously colored hair to be lightened by up to approximately 3 levels without the use of bleach. The amount of highlighting is determined by the strength of the formula of the hair color product and by the amount of time that the hair treatment iron is applied to each foil-covered section of hair.

The use of the hair treatment iron also decreases the amount of processing time needed to highlight hair, such that desired results are achieved within seconds versus minutes of processing time, when processing time is defined as the amount of time that either direct or indirect heat is transmitted to hair which is in contact with hair color product. This improvement in processing time occurs because of the direct heat which the hair treatment iron provides to the foil packets of hair between the metal plates of the hair treatment iron. Each foil packet of hair is typically held between the plates of the hair treatment iron for less than one minute. Because of the speed in which each section of hair may be treated with the hair treatment iron, an entire head of hair may be processed in less than 10 minutes. Depending on the thickness of the hair and the amount of lightening of color desired, in some instances an entire head of hair may be processed in less than 5 minutes.

The hair treatment iron allows a colorist to have more control over the timing of the highlighting process than is possible using indirect heat, such as heat from a hooded dryer. The hair treatment iron allows different foil-covered sections of hair to be treated with different amounts of heat, by varying the amount of time for which different foil packets are pressed between the plates of the hair treatment iron. This allows all of the sections of hair to finish processing and attain the desired color at the same time, by applying heat for a greater amount of time to sections which have had less contact time with the hair color product. In other words, less heat is applied to the first set of foil packets that were completed, and more heat is applied to the last set of foil packets that were completed. In this manner, the hair treatment iron facilitates the application of an even, repeatable color. Because the hair treatment iron allows all of the sections of hair to finish processing at the same time, the colorist is able to avoid the possibility of needing to wash hair color product out of certain sections of hair before the processing of other sections is complete. Alternatively, the application of the hair treatment iron may be timed to allow certain sections of hair to be lightened more than other sections. Increased variations may be achieved by varying the formula of the hair color product, such that different formulations are applied to different sections of hair, as well as by varying the processing times. Different coloring agents and various hair color and bleach combinations may also be used on the same head of hair. Because the hair treatment iron gives the colorist direct control over the amount of time that heat is applied to different sections of hair, the colorist has control over the final color of each section (i.e., each foil packet) of hair, which allows the colorist more control to create a desirable total balance of color.

The hair treatment iron is structurally different from traditional straightening/flat irons and curling irons in ways that allow the hair treatment iron to be used in highlighting processes. For example, the shape of the hair treatment iron is ergonomically designed to allow the plates of the iron to closely approach the scalp. Specifically, the edges of the plates that are closest to the scalp when the hair treatment iron is in use may be curved to correspond to the shape of a user's head. Alternatively, the plates may be curved in the longitudinal direction, in order to correspond to the shape of a user's head. Both of these designs allow heat to be applied close to the scalp, thereby allowing the hair to be tinted evenly throughout the length of the strand.

Moreover, the hair treatment iron also includes seals along the proximal edges of the plates. As used herein, the "proximal edge" of a structure is the edge of that structure which is closest to the scalp during use of the hair treatment iron. The seals may take the form of a silicone barrier. During the use of the hair treatment iron, steam may be released because of the chemicals applied to the hair. The seals along the proximal edges prevent the steam from flowing to and contacting the scalp, by preventing steam from exiting between the proximal edges of the plates. The hair treatment iron further includes venting passages, such as vent holes passing through the plates. Steam emanating from the foil packets of hair exits from the hair treatment iron through the venting passages. Preferably, the venting passages are oriented at an angle in relation to the proximal edges of the plates, so that steam is directed away from the user's scalp. Again, the stem produced is due to the chemicals applied to the hair in the foil packets being exposed to heat and the hair treatment iron itself does not provide means for generating or dispensing steam.

In some embodiments, the hair treatment iron includes a digital readout which displays the temperature. An indicator, such as an LED light, may also be included to assist in the measurement of time. For example, an LED light may blink after a programmable unit of time, much like a timer, to alert the colorist when heat has been applied to a section of hair for the desired amount of time. This timing function may assist the colorist in applying heat to different foil packets of hair for the same amount of time, if that is desired, or may also assist the colorist in varying the amount of time that heat is applied to different foil packets of hair.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE INVENTION

Figure 1:
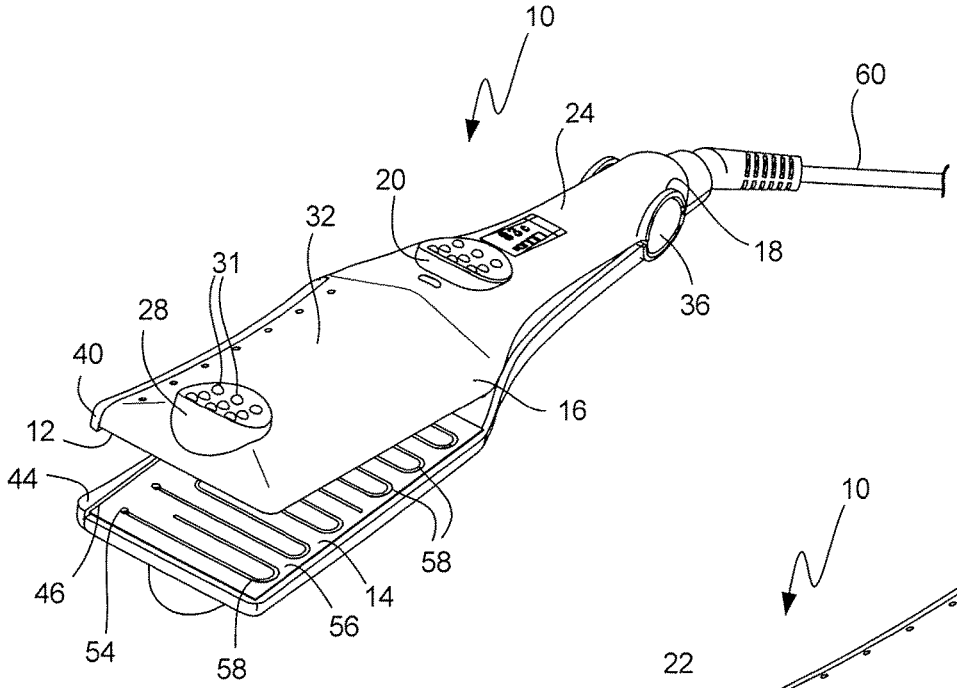
FIG. 1 is a top perspective view of a hair treatment iron of the present invention.

As shown in FIGS. 1-10, one embodiment of the present invention is hair treatment iron 10 including opposing plates. The opposing plates are a first plate 12 and a second plate 14 in a housing 16. Plates 12, 14 may be attached to housing 16 using a variety of methods, including adhesives, fasteners such as threaded fasteners, or a snap-fit connection. Plates 12, 14 are made from a heat conductive material, such as aluminum or other metals. Housing 16 is made from a material which is heat resistant, such as a heat resistant plastic.

Housing 16 includes a handle 18. The handle 18 includes handle finger grips 20, 22 near the end of the handle which is proximate to the plates 12, 14. The handle 18 comprises a first handle portion 24 and a second handle portion 26, with a first handle finger grip 20 on the first handle portion 24, and a second handle finger grip 22 on the second handle portion 26. The housing 16 also includes housing finger grips 28, 30 near the end of the housing 16 which is opposite to the handle 18. Housing 16 comprises a first housing portion 32 and a second housing portion 34, with a first housing finger grip 28 on the first housing portion 32, and a second housing finger grip 30 on the second housing portion 34. The finger grips 20, 22, 28, 30 may include raised features 31 and/or a high friction surface in order to improve a user's grip on the finger grips.

First housing portion 32 is connected to first handle portion 24, and second housing portion 34 is connected to second handle portion 26. The housing portions 32, 34 may be connected to the handle portions 24, 26 using a variety of methods, including adhesives, fasteners such as threaded fasteners, or snap-fit connections. Alternatively, first housing portion 32 and first handle portion 24 may together form one integrated piece. For example, first housing portion 32 and first handle portion 24 may together be one single piece of molded plastic. Second housing portion 34 and second handle portion 26 may also form one integrated piece.

In the embodiments shown in the figures, first housing portion 32 extends in the same longitudinal direction as first handle portion 24, and second housing portion 34 extends in the same longitudinal direction as second handle portion 26. This configuration allows the colorist to be close to the client's scalp, because the handle is close to the client's scalp when the hair treatment iron 10 is in use. This is desirable in order to allow the colorist to easily see how closely the hair treatment iron 10 approaches the client's scalp. However, in other embodiments, there may be an angle between housing portions 32, 34 and handle portions 24, 26. For example, housing portions 32, 34 may extend to the side, at a 90° angle from handle portions 24, 26. The housing portions 32, 24 may also extend at any other angle from the handle portions 24, 26.

Figure 5:
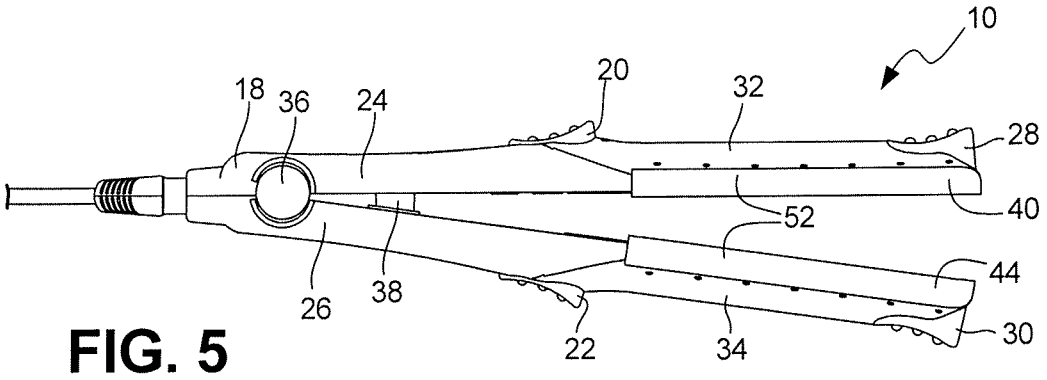
FIG. 5 is a side view of the hair treatment iron of FIG. 1.
Figure 6:
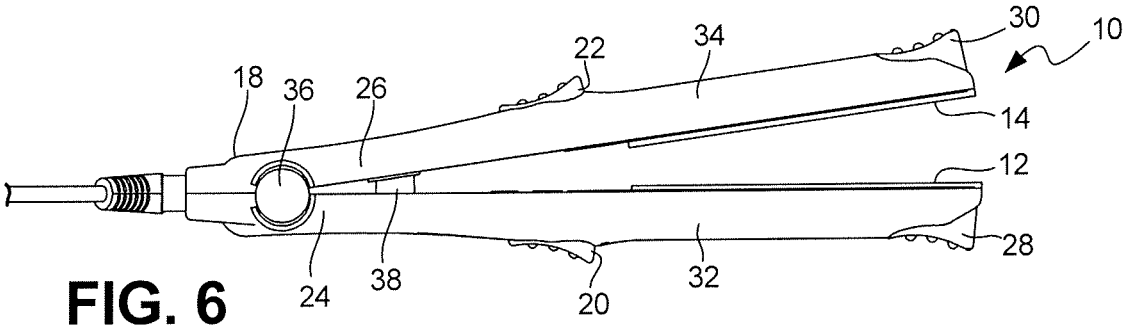
FIG. 6 is another side view of the hair treatment iron of FIG. 1.

A pivot 36 and an alignment bracket 38, shown in FIGS. 5 and 6, are located between the first handle portion 24 and second handle portion 26, with pivot 36 located near the end of the handle 18 which is opposite to plates 12, 14, and with alignment bracket 38 located nearer to plates 12, 14. The alignment bracket 38 acts to maintain the first handle portion 24 and first housing portion 32 in alignment with the second handle portion 26 and second housing portion 34.

Figure 9:
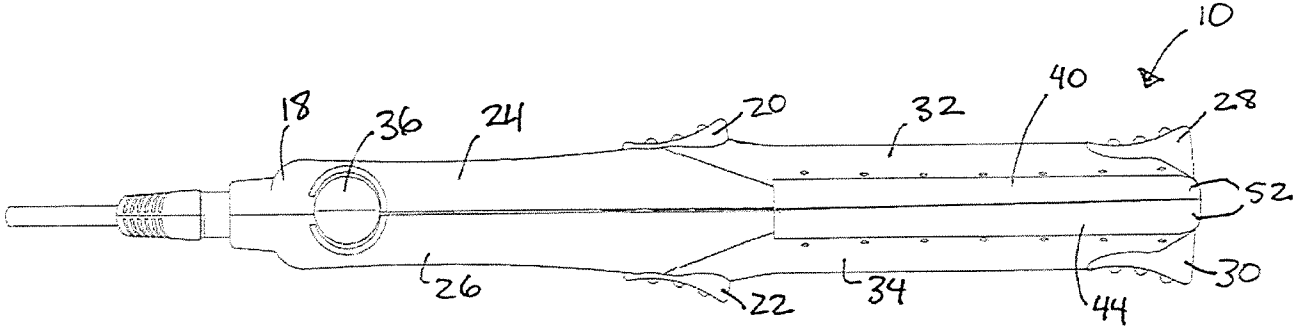
FIG. 9 is a side view of the hair treatment iron of FIG. 1 in a closed position.
Figure 10:
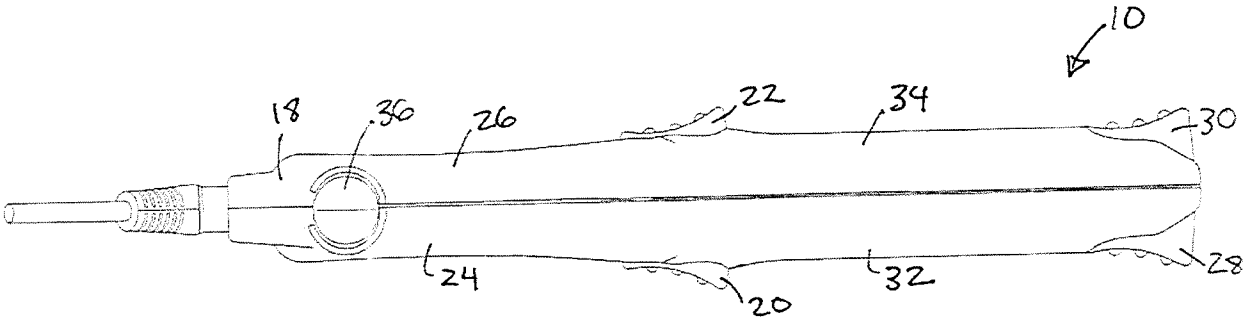
FIG. 10 is another side view of the hair treatment iron of FIG. 1 in a closed position.

A coil spring around pivot 36 acts to force the first plate 12 and second plate 14 apart from each other, to place the hair treatment iron 10 in an open position as shown in FIGS. 1-6. The coil spring may be around pivot 36 or incorporated within the structure of pivot 36. In alternative embodiments, springs set apart from the pivot 36, such as flat springs, may be included. The plates 12, 14 are brought closer together by a user exerting pressure against handle finger grips 20, 22 and housing finger grips 28, 30, thereby placing the hair treatment iron 10 in a closed position as shown in FIGS. 9-10. In some embodiments, the hair treatment iron 10 may include a locking mechanism such as a ratchet mechanism so that, once the hair treatment iron 10 is placed in a closed position, the hair treatment iron may be locked in that position without the need for the colorist to apply continuous pressure to keep plates 12 and 14 close together.

The hair treatment iron 10 also includes a seal 40 along the proximal edge 42 of the first plate 12, and a seal 44 along the proximal edge 46 of the second plate 14, wherein the proximal edges 42, 46 are the edges of the plates that are closest to the scalp during use of the hair treatment iron 10. See FIG. 3. The seals 40, 44 may take the form of a silicone barrier. During the use of the hair treatment iron, steam is released because of the chemicals applied to the hair. The seals 40, 44 prevent the steam from flowing to and contacting the scalp, by preventing steam from exiting between the proximal edges 42, 46 of the plates 12, 14. In the embodiment shown in FIGS. 1-10, the seals 40, 44 are adjacent to the plates 12, 14 and to housing portions 32, 34. In an alternative embodiment, the plates 12, 14 may not extend to the proximal edges 48, 50 (see FIGS. 7 and 8) of the housing portions 32, 34. In such an alternative embodiment, the seals 40, 44 would be adjacent to the housing portions 32, 34, and may not be in direct contact with the plates 12, 14.

The proximal edges 52 of seals 40, 44 (see FIGS. 3 and 4), and the proximal edges 48, 50 of the housing portions 32, 34 (see FIGS. 7 and 8), are curved in order to correspond to the shape of a user's scalp. In an alternative embodiment, the proximal edges 42, 46 of plates 12, 14 are curved in order to correspond to the shape of the user's scalp, and the widths of the seals 40, 44 may remain constant along the length of the plates. In such an embodiment, the curved edges of the plates allow the plates 12, 14 to closely approach the user's scalp along the length of the plates.

The hair treatment iron further includes venting passages 54 passing through the plates 12, 14. See FIGS. 7 and 8. Steam emanating from the foil packets of hair exits from the hair treatment iron 10 through the venting passages 54. In the embodiment shown in FIGS. 1-10, seven venting passages 54 are included in each of plates 12 and 14. However, in other embodiments, a lesser or greater number of venting passages may be present. Also, in other embodiments, venting passages may pass through only one of the plates 12, 14. The venting passages 54 pass through the plates 12, 14 from the inner surface 56 (see FIG. 1) to the outer surface of each plate at an acute angle in relation to the proximal edges 42, 46, so that steam is directed away from the user's scalp. The venting passages 54 may pass through the plates at any angle which directs steam away from the user's scalp, such as at an angle in the range of about 40°-50°. The venting passages 54 also continue from the outer surface of each plate 12, 14 through the first housing portion 32 and the second housing portion 34.

In the embodiment shown in FIGS. 1-10, venting passages 54 have a circular cross section, such that the venting passages 54 are circular apertures passing through the plates 12, 14 and housing portions 32, 34. However, in alternative embodiments, the venting passages 54 may have different shapes and/or structures. For example, the venting passages may have an elliptical, square, or rectangular cross section. As another example, hoses may extend through or from the plates 12, 14. If hoses are used as venting passages 54, the venting passages may extend past the outer surfaces of the housing portions. Accordingly, various structures which are capable of venting steam may be used as venting passages 54.

Figure 2:
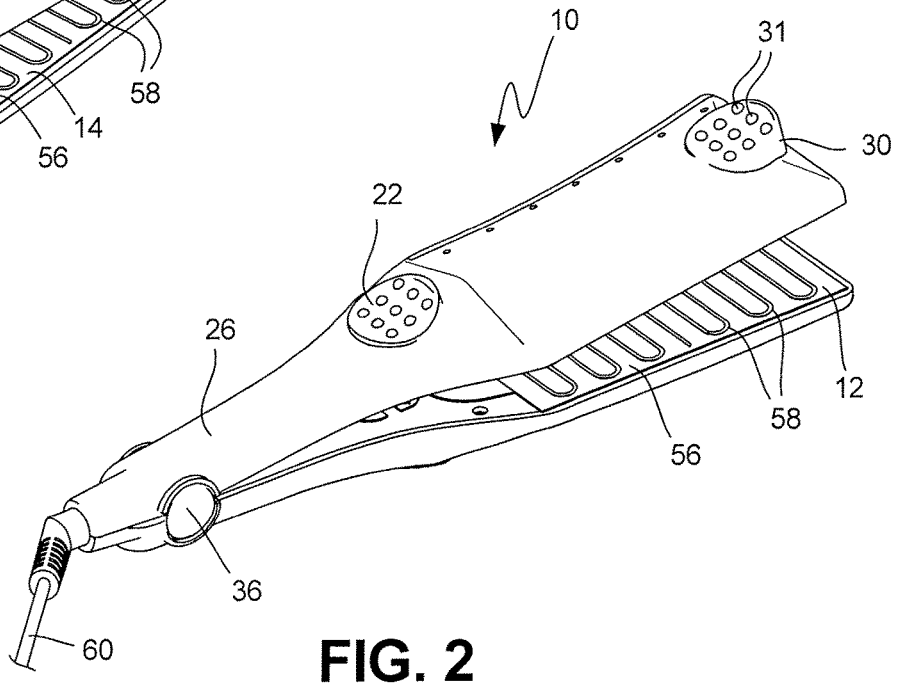
FIG. 2 is a bottom perspective view of the hair treatment iron of FIG. 1.
Figure 3:
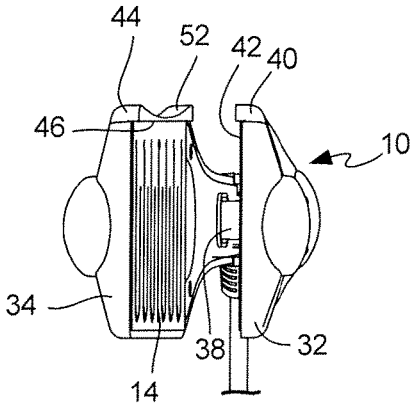
FIG. 3 is a front view of the hair treatment iron of FIG. 1.
Figure 4:
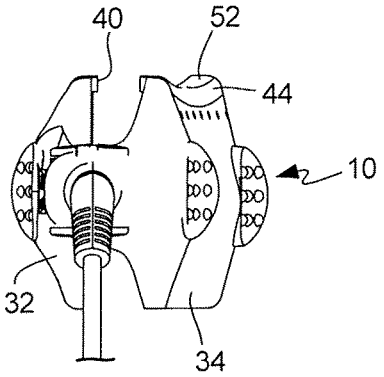
FIG. 4 is a rear view of the hair treatment iron of FIG. 1.

Channels 58 are defined by grooves on the inner surfaces 56 of plates 12, 14, as shown in FIGS. 1 and 2. In the embodiments shown in the figures, most of the channels 58 are grooves shaped like a J along the inner surfaces 56 of the plates, but grooves in other shapes and configurations are also possible, such as U-shaped or straight grooves. In one embodiment, a cross-section of each channel 58 is a semi-circle. In other embodiments, the cross-section of each channel 58 may form another shape, such as a square, a triangle, or a portion of a circle other than a semi-circle.

The channels 58 form a flow-channeling system which is designed to direct steam and residue from the hair color product, which may emanate from the foil packets of hair when the hair treatment iron 10 is in use, away from the client's scalp. A venting passage 54 is located at one terminal end of each channel 58, while the other terminal end of each channel 58 is closed, as shown in FIG. 1. Steam and residue may pass through the venting passages 54 or be directed along the channels 58 away from the client's scalp. The closed terminal end of each channel 58, which is opposite the end terminating at venting passage 54, is preferably set apart from the proximal edges 42, 46 of plates 12, 14, in order to keep steam and residue away from the scalp. In alternative embodiments, both or neither of the terminal ends of each channel 58 may be closed.

Figure 7:
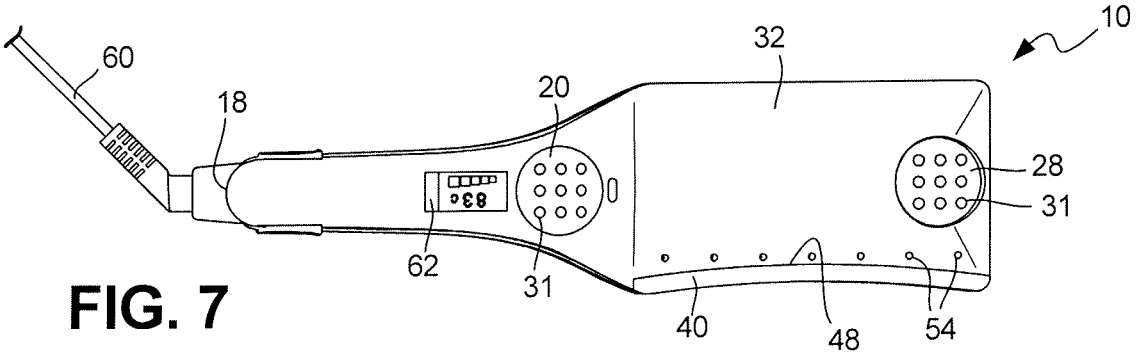
FIG. 7 is a top view of the hair treatment iron of FIG. 1.
Figure 8:
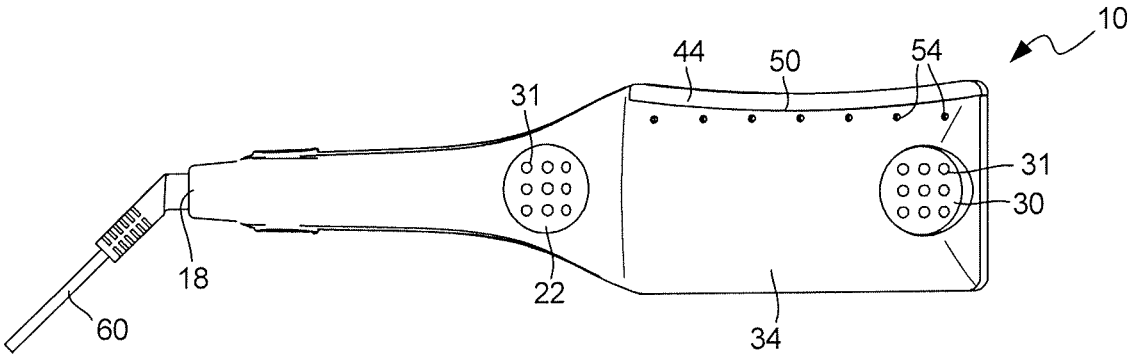
FIG. 8 is a bottom view of the hair treatment iron of FIG. 1.

The hair treatment iron 10 is powered by electricity and includes an electrical cord 60. However, in other embodiments, the hair treatment iron 10 may be powered by other power sources, such as batteries or butane. The electrical cord 60 may include a swivel and a bend in the cord near the end of handle 18, as shown in FIGS. 7 and 8, in order to angle the electrical cord away from the colorist's arm. The hair treatment iron 10 includes heating elements (not shown) located behind plates 12, 14. Pressing the power button 62 located on handle 18 (see FIG. 7) causes power to flow to the heating elements so that the heating elements will heat the inner surfaces 56 of plates 12, 14.

Figure 11:
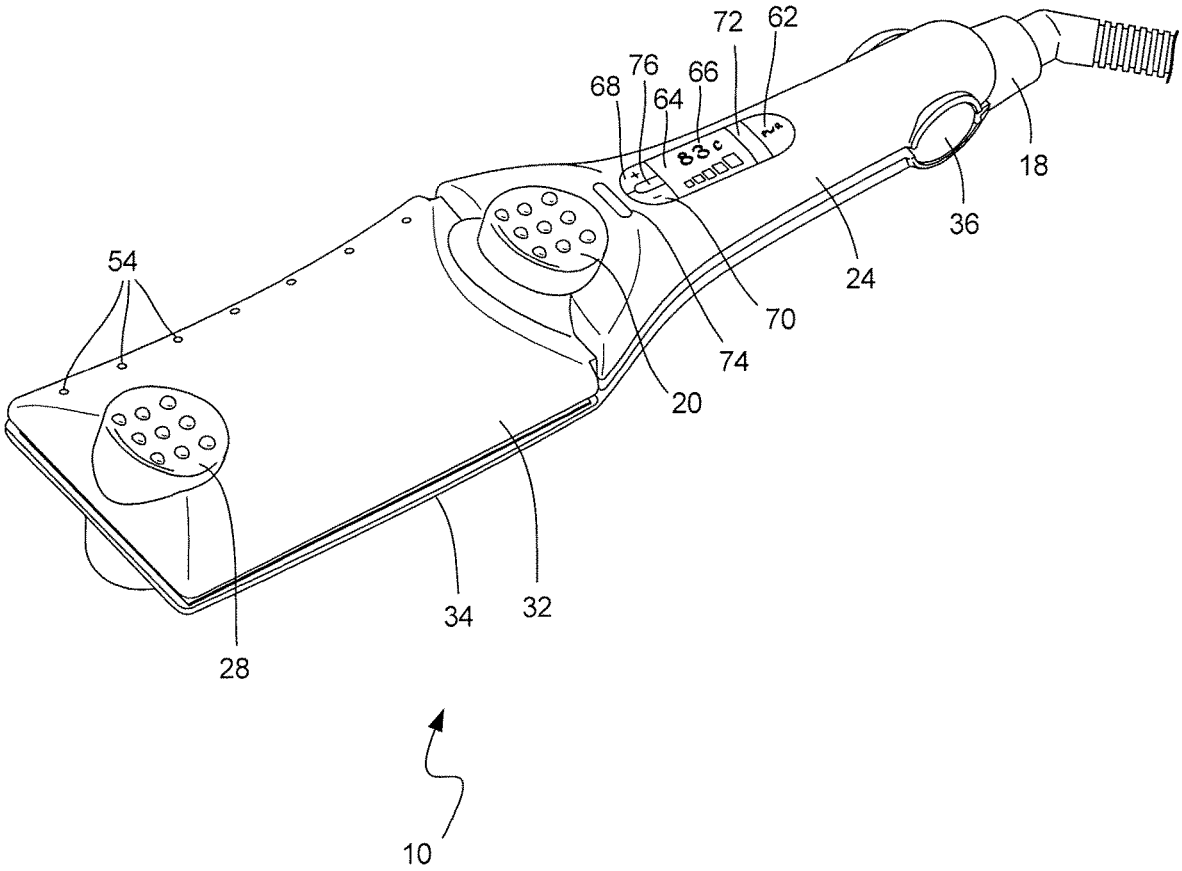
FIG. 11 is a top perspective view of a second embodiment of the hair treatment iron of the present invention.

FIG. 11 is a top perspective of a second embodiment of a hair treatment iron 10 similar to the embodiment shown in FIGS. 1-10. As shown in FIG. 11, hair treatment iron 10 includes a digital readout 64 including a temperature display 66 that shows the temperature at which the hair treatment iron 10 is programmed. The programmed temperature may be adjusted by pressing a control button 68 to increase the temperature, and a control button 70 to decrease the temperature. In other embodiments, other forms of controls for controlling the temperature setting may be used, such as a dial or a keypad. A heat indicator 72, such as an LED light, emits light when the plates 12, 14 have reached the programmed temperature. The programmed temperature to which the plates 12, 14 should be heated, for use in coloring or highlighting hair, is preferably in the range of from about 80° C. to about 85° C.

A time indicator 74, such as an LED light, may also be included to assist in the measurement of time. For example, time indicator 74 may blink or emit a steady light after a programmable unit of time has passed, much like a timer, to alert the colorist when heat has been applied to a section of hair for the desired amount of time. A pressure or distance sensor (not shown) may be included in the hair treatment iron 10. The hair treatment iron 10 may be programmed so that when the pressure or distance sensor indicates that the hair treatment iron 10 is in the closed position, the hair treatment iron begins timing. Alternatively, the hair treatment iron 10 may include a start button which the colorist may press to cause the hair treatment iron to begin timing. Once the programmed amount of time has elapsed, the time indicator 74 is activated to alert the colorist that the hair treatment iron 10 has been in the closed position for the programmed amount of time. This timing function may assist the colorist in applying heat to different foil packets of hair for the same amount of time, if that is desired, or may also assist the colorist in varying the amount of time that heat is applied to different foil packets of hair. Hair treatment iron 10 includes a time/temperature button 76 which, when pressed, causes the digital readout 64 to switch from displaying temperature to displaying time. When time is displayed on the digital readout 64, the programmed time may be adjusted by pressing by pressing the control button 68 to increase the programmed time, and the control button 70 to decrease the programmed time. Alternatively, two separate sets of digital readouts 64 and control buttons 68, 70 may be included on hair treatment iron 10. Also, the digital readout 64 may be set to show the amount of time that has elapsed since the hair treatment iron 10 has been in the closed position, so that the colorist may monitor the amount of time elapsed instead of, or in addition to, relying on time indicator 74 to emit light when a programmed unit of time has passed.

After use, the hair treatment iron 10 may be shut off by pressing the power button 62. In some embodiments, the hair treatment iron 10 may be programmed to shut off automatically after a certain amount of time, as a safety feature.

Figure 12:
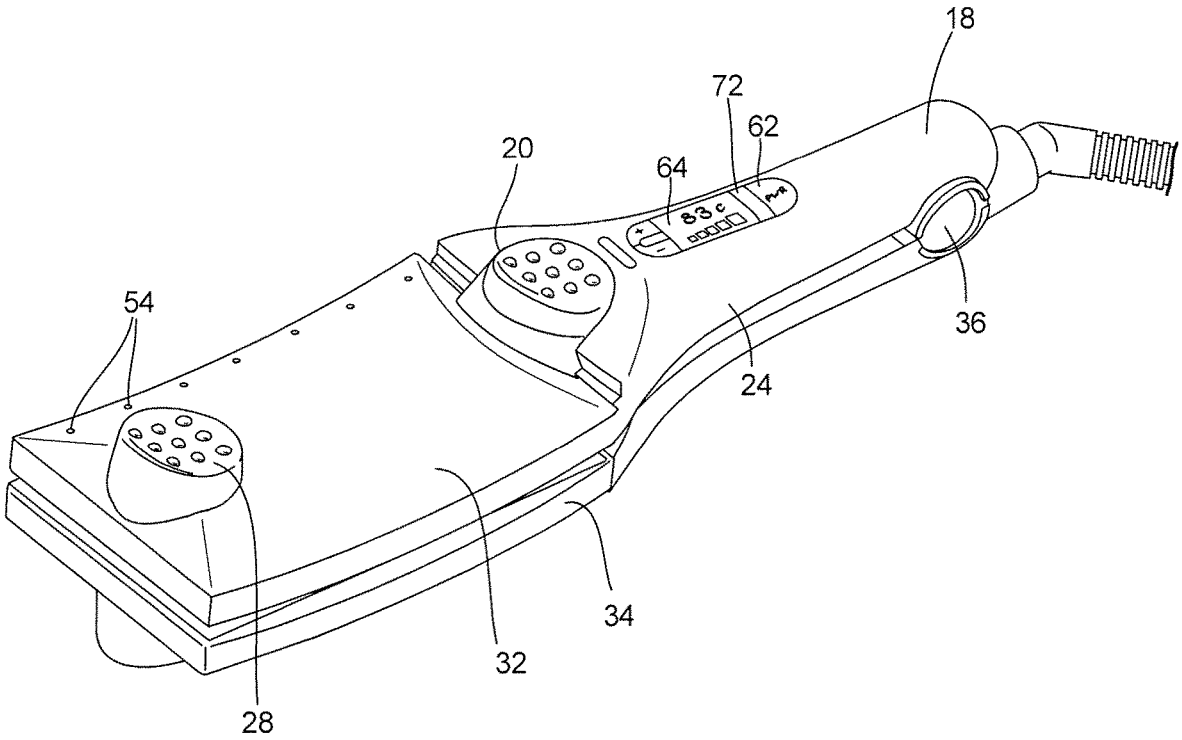
FIG. 12 is a top perspective view of a third embodiment of the hair treatment iron of the present invention.
Figure 13:
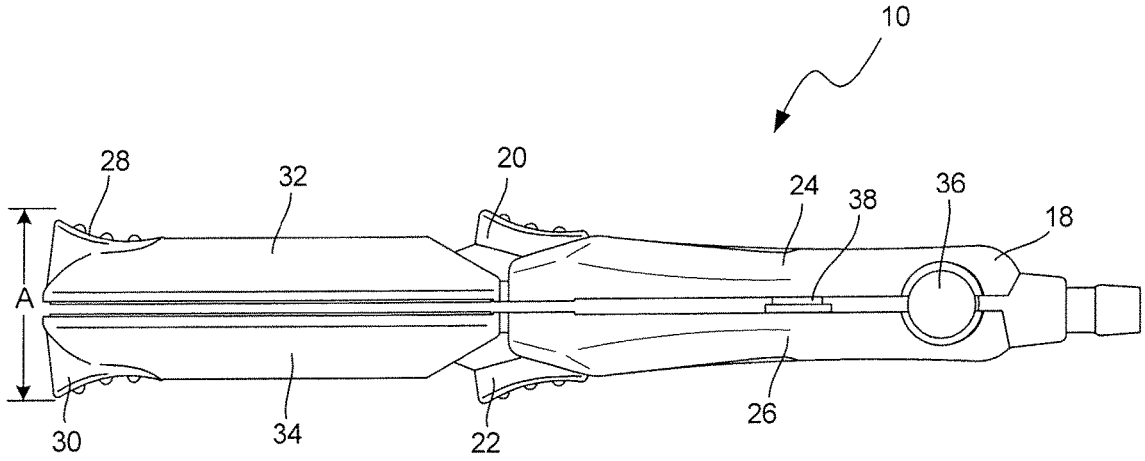
FIG. 13 is a side view of the hair treatment iron of FIG. 11.
Figure 14:
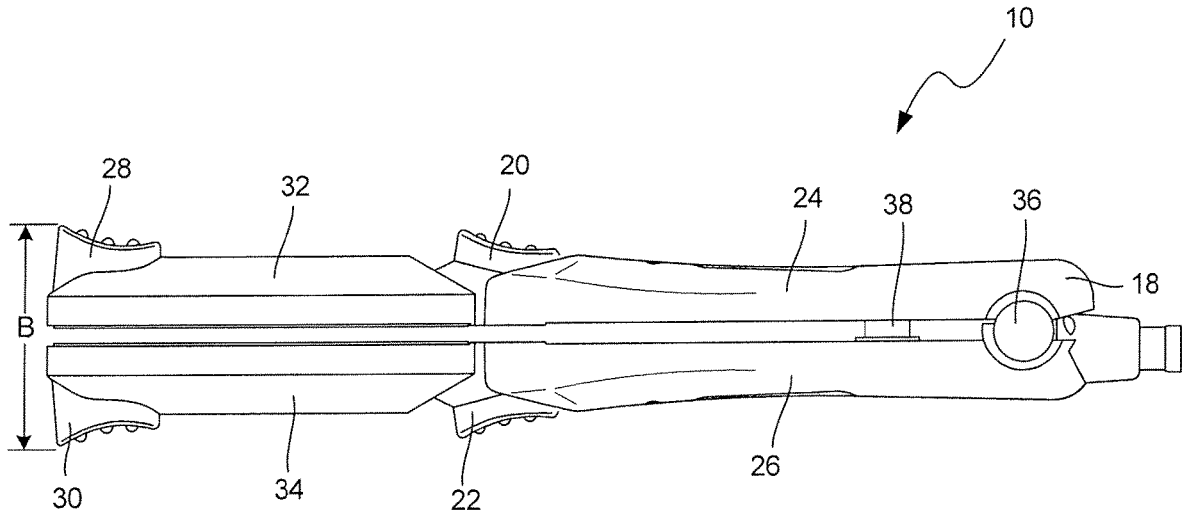
FIG. 14 is a side view of the hair treatment iron of FIG. 12.

Various shapes and sizes of hair treatment iron 10 may be made in accordance with the present invention. FIG. 12 shows a third embodiment of hair treatment iron 10 which is similar to the second embodiment shown in FIG. 11. The embodiments shown in FIGS. 11 and 12 are shaped and sized differently. For example, housing portions 32, 34 shown in FIG. 12 have angled corners, while housing portions 32, 34 shown in FIG. 11 have rounded corners. FIG. 13 is a side view of the embodiment of FIG. 11, and FIG. 14 is a side view of the embodiment of FIG. 12. The approximate widths of the embodiments of FIGS. 13 and 14 are represented by distances A and B, respectively. The embodiment of FIG. 13 has a width of approximately 5.2 cm, while the embodiment of FIG. 14 has a width of approximately 6.8 cm. Other embodiments may have different widths, such as from about 3.5 cm to about 8.0 cm, or from about 4.5 cm to about 7.0 cm.

Figure 15:
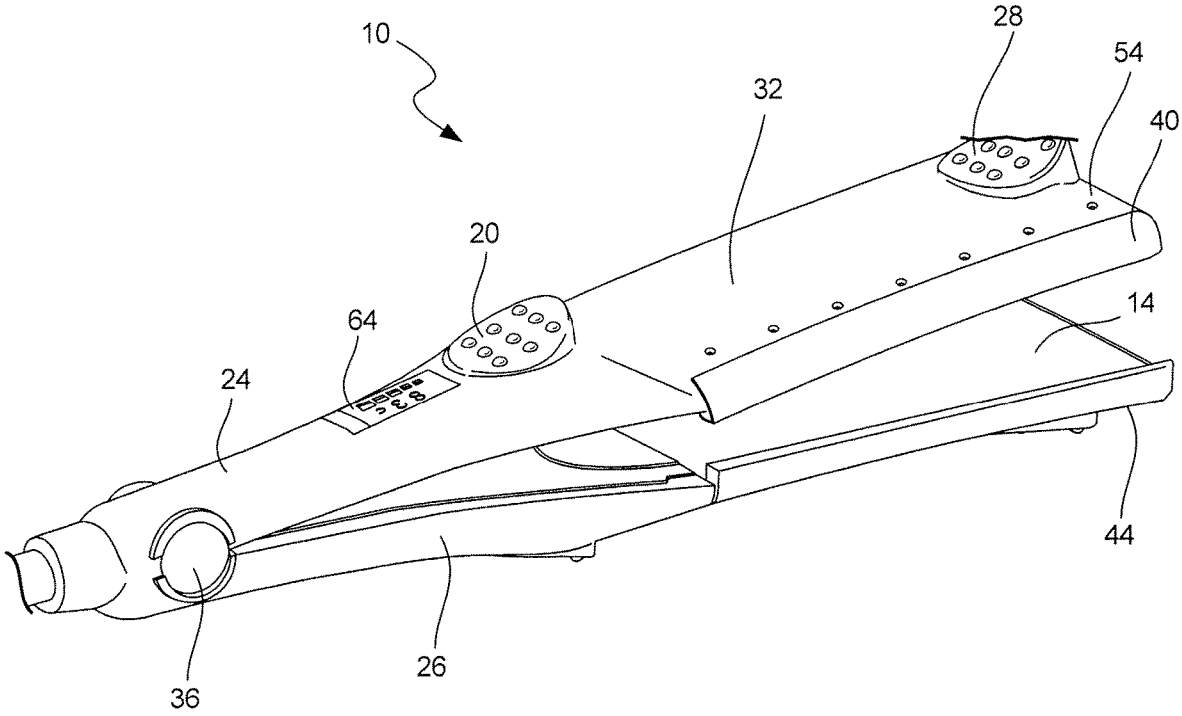
FIG. 15 is a partial top perspective view of a fourth embodiment of the hair treatment iron of the present invention.
Figure 16:
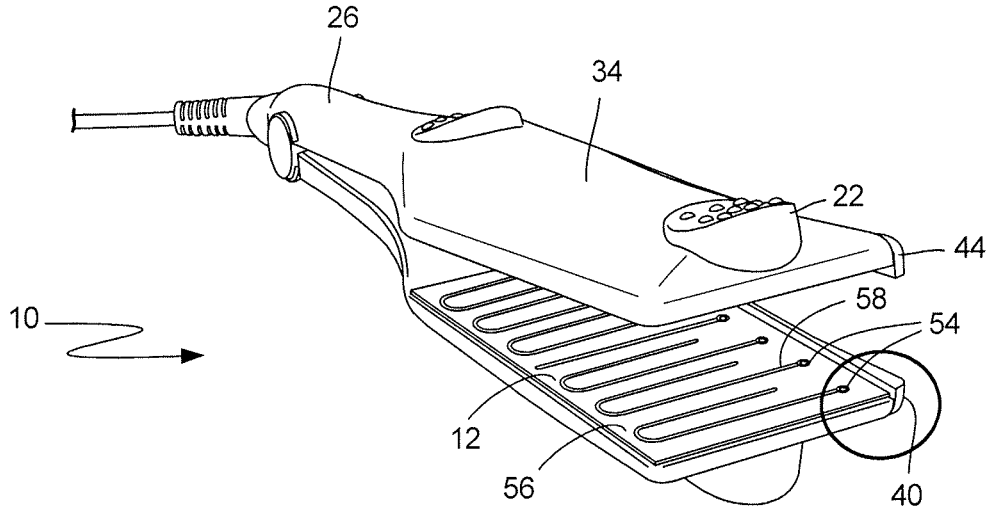
FIG. 16 is a bottom perspective view of the hair treatment iron of FIG. 15.
Figure 17:
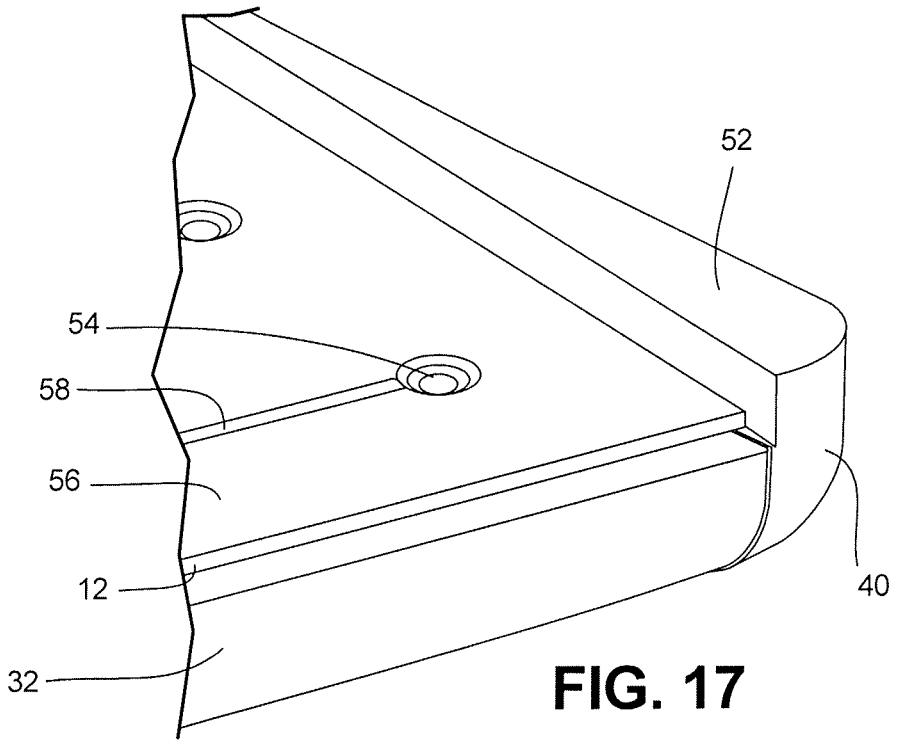
FIG. 17 is an enlarged view of the circled portion of the hair treatment iron shown in FIG. 16.

A partial perspective view of a fourth embodiment of hair treatment iron 10 is Shown in FIGS. 15-17. Seals 40, 44 are more pronounced in this fourth embodiment than in the previous embodiments. FIGS. 16 and 17 show how seals 40 is curved to correspond to the shape of a user's head. Seal 44 is curved in a manner corresponding to the curve of seal 40, such that seal 40 and seal 44 are pressed tightly together when the hair treatment iron 10 is in a closed position, thereby protecting the user's scalp from steam while allowing a close approach to the scalp.

Figure 18A:
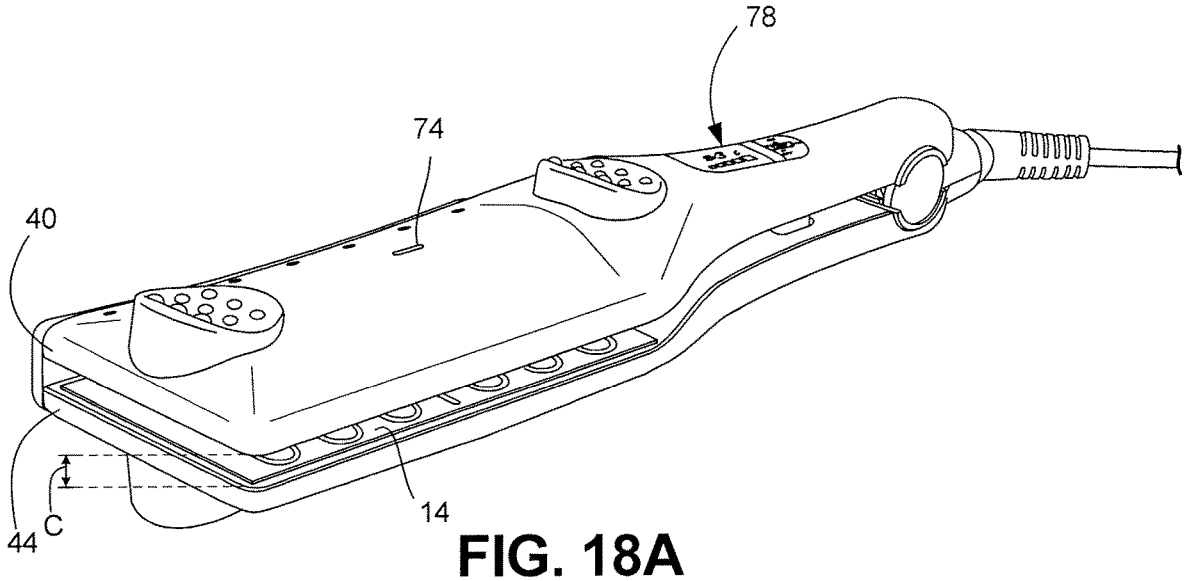
FIG. 18A is a top perspective view of a fifth embodiment of the hair treatment iron of the present invention.
Figure 18B:
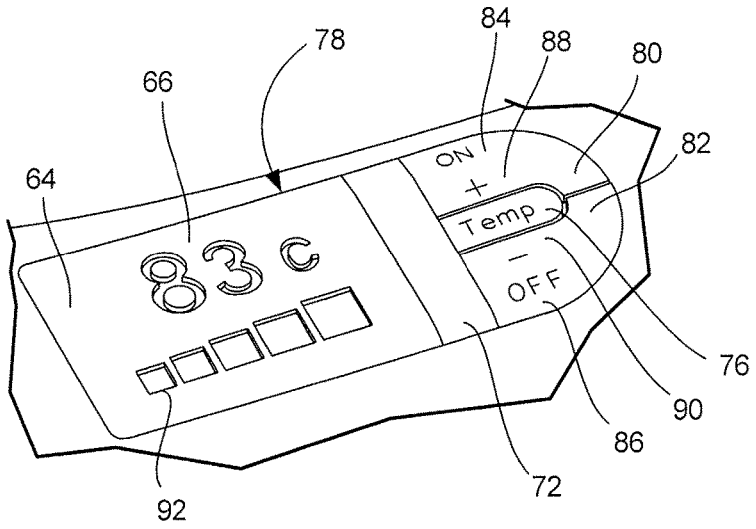
FIG. 18B is an enlarged view of the control panel of the hair treatment iron.
Figure 19:
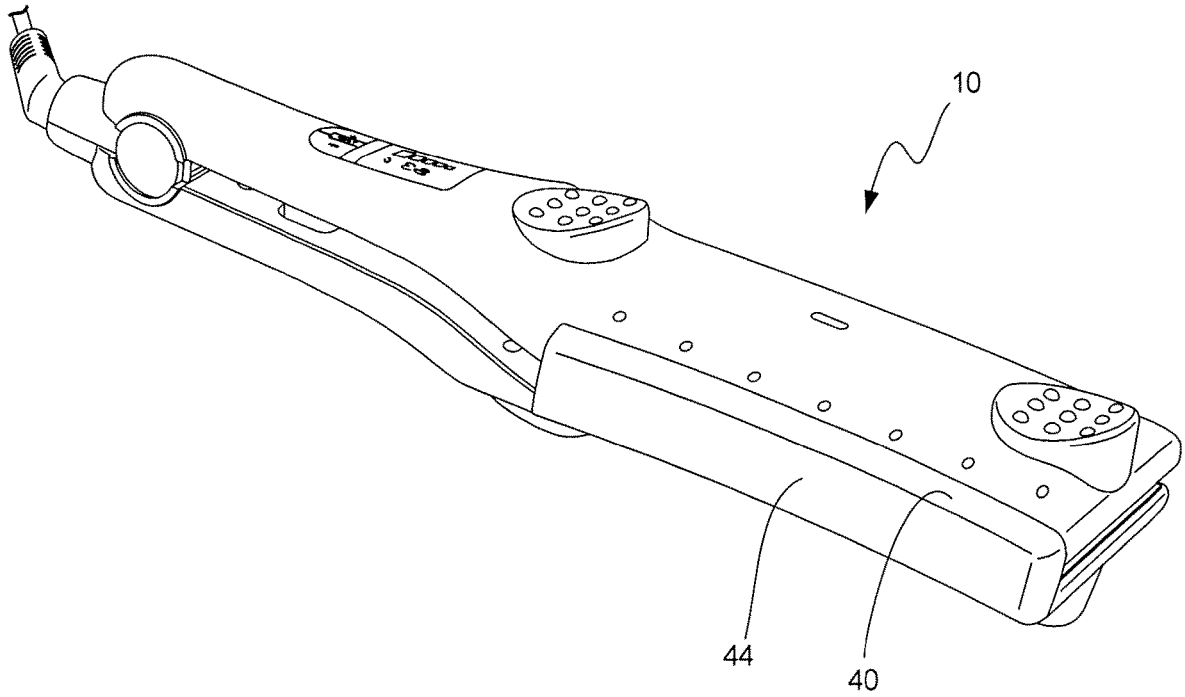
FIG. 19 is a top perspective view of the hair treatment iron of FIG. 18A.
Figure 20:
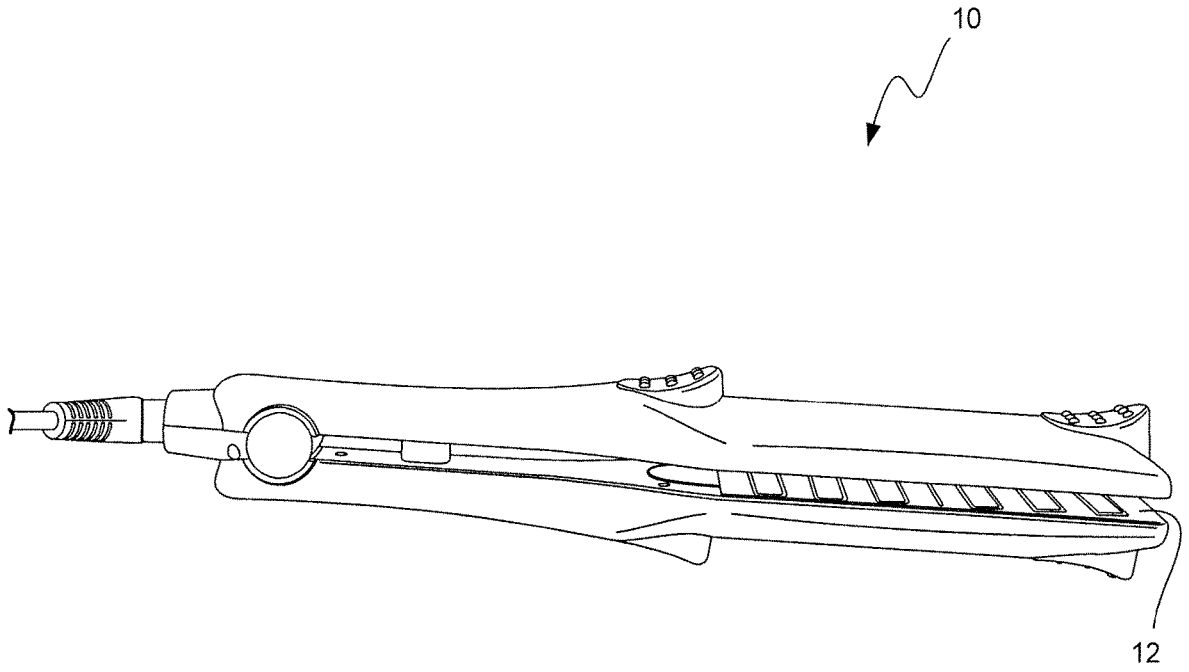
FIG. 20 is a side perspective view of the hair treatment iron of FIG. 18A.

As fifth embodiment of the hair treatment iron 10 is shown in FIGS. 18A-26B. In FIGS. 18A, 19, and 20, the hair treatment iron 10 is in a closed position, with the seals 40, 44 pressed together along their entire length. When hair treatment iron 10 is in this closed position when in use, steam emanating from the space between plates 12, 14 is not able to pass between seals 40, 44. Therefore, the design, which allows seals 40, 44 to be pressed together along their entire length, serves to protect the user's scalp from steam. The space between plates 12, 14 when hair treatment iron 10 is in a closed position is represented by distance C in FIG. 18A. This distance is sufficient to allow space for sections of hair enclosed in foil packets to be pressed between plates 12, 14, while still allowing seals 40, 44 to be pressed tightly together. In the embodiment shown in FIG. 18A, this distance is approximately 0.635 cm, or 0.25 in. In other embodiments, this distance may be different, such as from about 0.30 cm to about 0.90 cm, or from about 0.50 cm to about 0.70 cm.

As shown in FIG. 18A, hair treatment iron 10 includes a control panel 78, which is shown in an enlarged view in FIG. 18B. Control panel 78 includes control buttons 80, 82. The heat treatment iron 10 may be turned on by pressing the top portion 84 of control button 80, and may be turned off by pressing the bottom portion 86 of control button 82. Control panel 78 also a digital readout 64 including a temperature display 66 that shows the temperature at which the hair treatment iron 10 is programmed. The programmed temperature may be adjusted by pressing a bottom portion 88 of control button 80 to increase the temperature, and a top portion 90 of control button 82 to decrease the temperature. In other embodiments, other forms of controls for controlling the temperature setting may be used, such as a dial or a keypad. A heat indicator 72, such as an LED light, emits light when the plates 12, 14 have reached the programmed temperature. The digital readout 64 may include graphical representation 92, such as a series of bars, to indicate the progress of heat treatment iron 10 in heating to the programmed temperature. The programmed temperature to which the plates 12, 14 should be heated, for use in coloring or highlighting hair, is preferably in the range of from about 80° C. to about 85° C., or in the range of from about 82° C. to about 84° C. However, different heat ranges may be used to accommodate the use of different hair coloring or tinting products.

A time indicator 74, such as an LED light, may also be included to assist in the measurement of time. For example, time indicator 74 may blink or emit a steady light after a programmable unit of time has passed, much like a timer, to alert the colorist when heat has been applied to a section of hair for the desired amount of time. A pressure or distance sensor (not shown) may be included in the hair treatment iron 10. The hair treatment iron 10 may be programmed so that when the pressure or distance sensor indicates that the hair treatment iron 10 is in the closed position, the hair treatment iron begins timing. Alternatively, the hair treatment iron 10 may include a start button which the colorist may press to cause the hair treatment iron to begin timing. Once the programmed amount of time has elapsed, the time indicator 74 is activated to alert the colorist that the hair treatment iron 10 has been in the closed position for the programmed amount of time. This timing function may assist the colorist in applying heat to different foil packets of hair for the same amount of time, if that is desired, or may also assist the colorist in varying the amount of time that heat is applied to different foil packets of hair. Hair treatment iron 10 may include a time/temperature button 76 which, when pressed, causes the digital readout 64 to switch from displaying temperature to displaying time. When time is displayed on digital readout 64, the programmed time may be adjusted by pressing the bottom portion 88 of control button 80 to increase the temperature, and a top portion 90 of control button 82 to decrease the temperature. Alternatively, two separate sets of digital readouts 64 and control buttons 80, 82 may be included on hair treatment iron 10. Also, the digital readout 64 may be set to show the amount of time that has elapsed since the hair treatment iron 10 has been in the closed position, so that the colorist may monitor the amount of time elapsed instead of, or in addition to, relying on time indicator 74 to emit light when a programmed unit of time has passed.

After use, the hair treatment iron 10 may be shut off by pressing the bottom portion 86 of control button 82. In some embodiments, the hair treatment iron 10 may be programmed to shut off automatically after a certain amount of time, as a safety feature.

Figure 21:
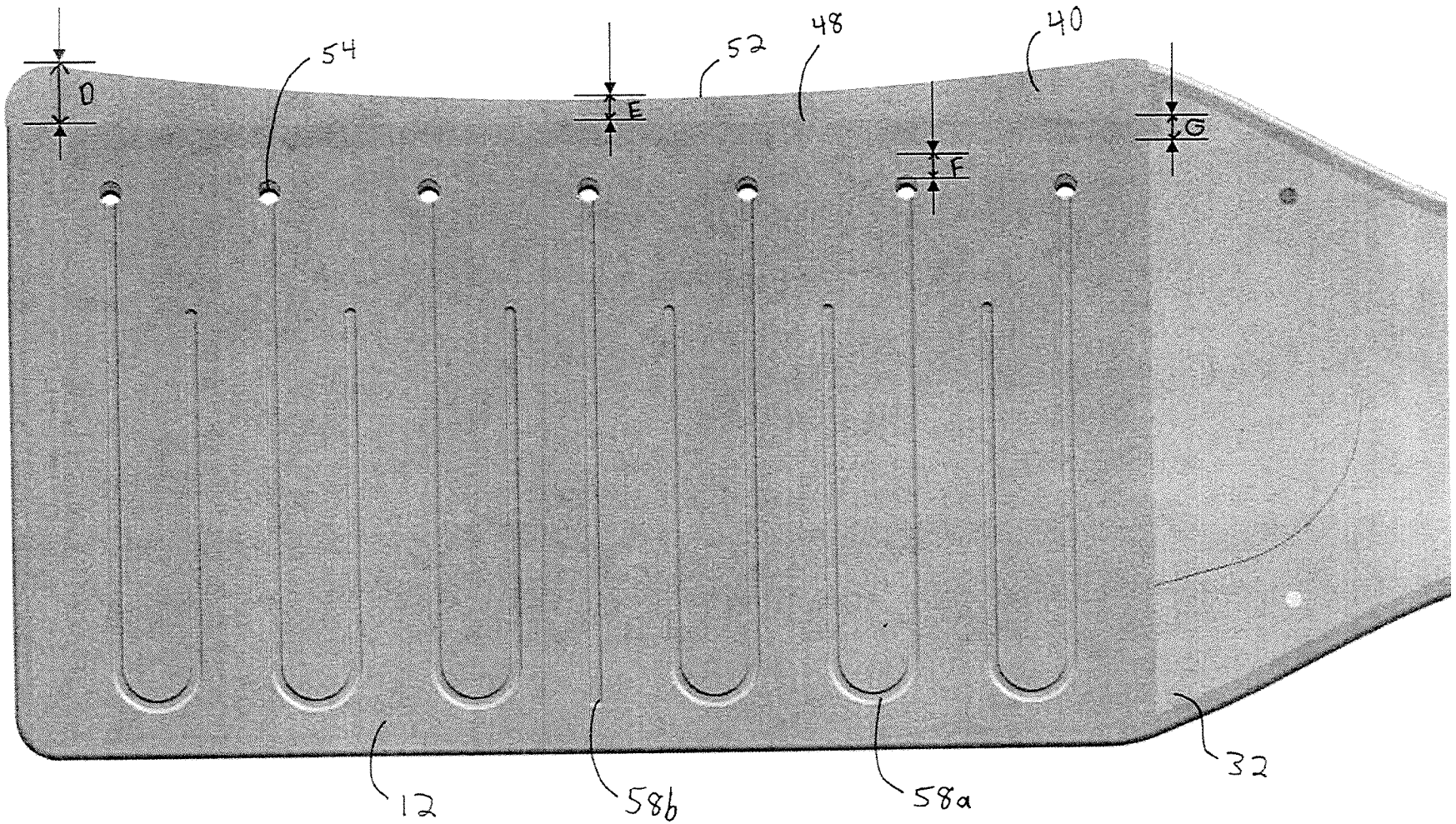
FIG. 21 is a bottom view of a plate and housing portion of the hair treatment iron of FIG. 18A.

FIG. 21 shows first plate 12 in first housing portion 32. This view shows that venting passages 54 are angled such that steam generated proximate to first plate 12 is directed away from seal 40 and, consequently, away from a user's scalp. Channels 58, which each terminate at a venting passage 54, are also shown. Channels 58*a* shown in FIG. 21 are shaped like a J along on the inner surface of first plate 12, while the channel 58*b* in the approximate center of first plate 12 is straight. Channels 58 in other shapes and configurations may also be used. FIG. 21 shows seven channels 58, but in other embodiments, different numbers of channels may be used, such as from 4 to 10 channels, or from 6 to 8 channels.

In FIG. 21, the width of seal 40 at its widest and narrowest points are represented by distances D and E, respectively. The width is sufficient to create a safe separation between the user's scalp and first plate 12, while still allowing the first plate 12 to closely approach the user's scalp. The widest points, which occur at the ends of seal 40, have widths of approximately 0.635 cm, or 0.25 in. The narrowest point, which occurs at or near the center of seal 40, has a width of approximately 0.3175 cm, or 0.125 in. In other embodiments, the seal 40 may have different widths. For example, the width may range from about 0.2 cm to about 0.9 cm, or from about 0.25 cm to about 0.7 cm. The width of first plate 12 between venting passage 54 and housing portion 32, which is represented by distance F, and the width of housing portion 32 between seal 40 and first plate 12, which is represented by distance G, are each approximately 0.3175 cm, or 0.125 in. However, in other embodiments, distances F and G may differ from each other. Also, distances F and G may be different in other embodiments, such as from about 0.1 cm to about 0.5 cm, or from about 0.2 cm to about 0.4 cm.

The proximal edge 48 of housing portion 32 is straight in FIG. 21, while the proximal edge 52 of seal 40 is curved in order to approximately follow the curve of a user's scalp. However, alternative configurations are possible, such as a design in which both the proximal edge 48 of housing portion 32 and the proximal edge 52 of seal 40 are curved. If the proximal edge 48 of housing portion 32 is curved, the width of seal 40 may remain constant along its length, while still having a curved proximal edge 52.

Figures 22A, 22B:
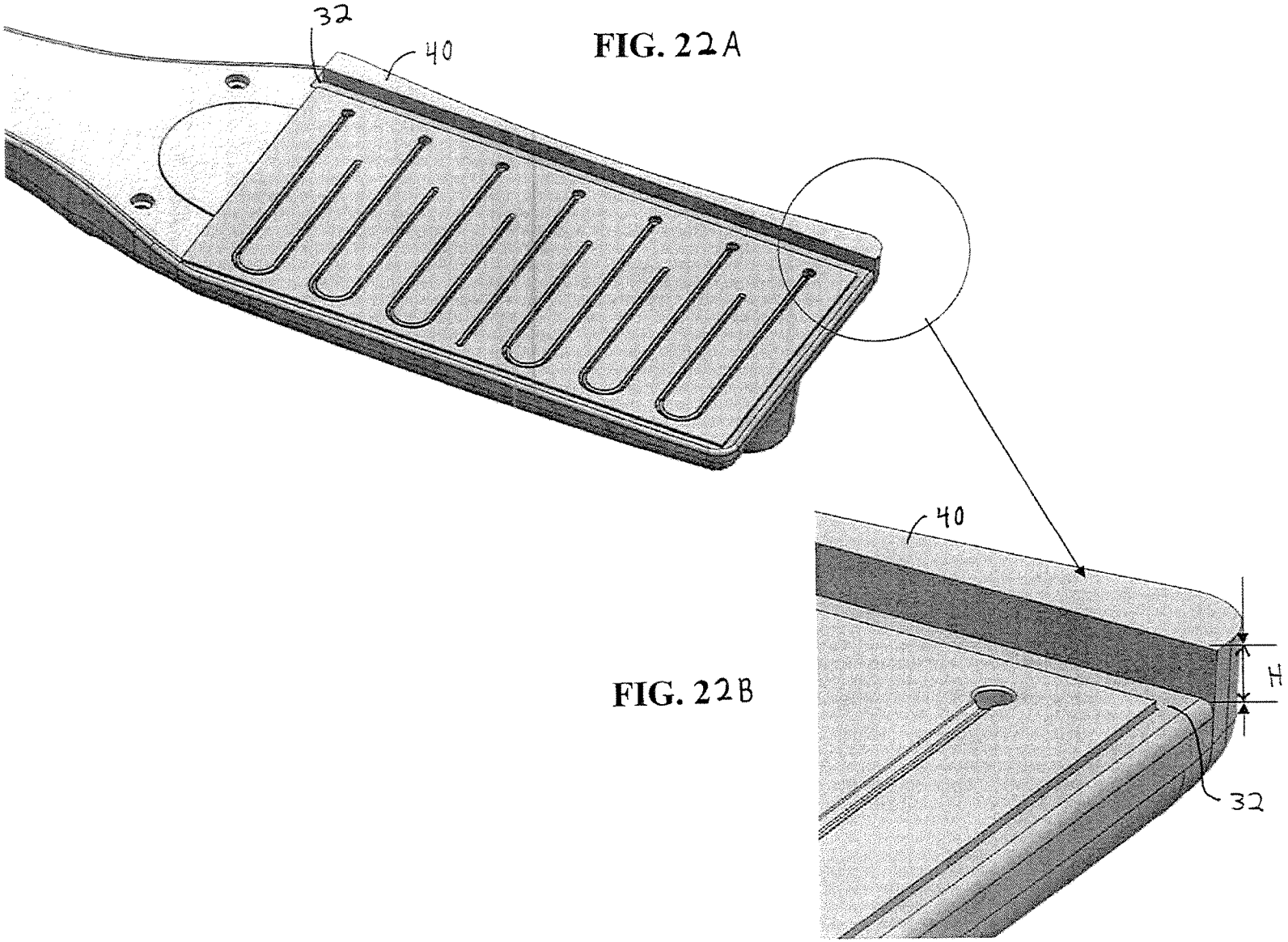
FIG. 22A is a bottom perspective view of the plate and housing portion shown in FIG. 21.
FIG. 22B is an enlarged view of the circled portion of FIG. 22A.

While the width of seal 40 varies in the embodiment of FIG. 21, the height of seal 40 above housing portion 32 remains constant, as shown in FIGS. 22A-22B. The corresponding height of seal 44 also remains constant, thereby allowing seals 40 and 44 to be pressed together along their entire length when hair treatment iron 10 is closed. The distance to which seal 40 extends above housing portion 32 is represented by distance H in FIG. 22B. If distance H of seal 40 were to vary, the corresponding distance of seal 44 should also vary such that seals 40 and 44 may still be pressed together along their entire length. In the embodiment shown, distance H is approximately 0.3175 cm, or 0.125 in. However, this distance may be different in other embodiments, such as from about 0.15 cm to about 0.45, or from about 0.25 cm to about 0.35 cm.

Figure 23:
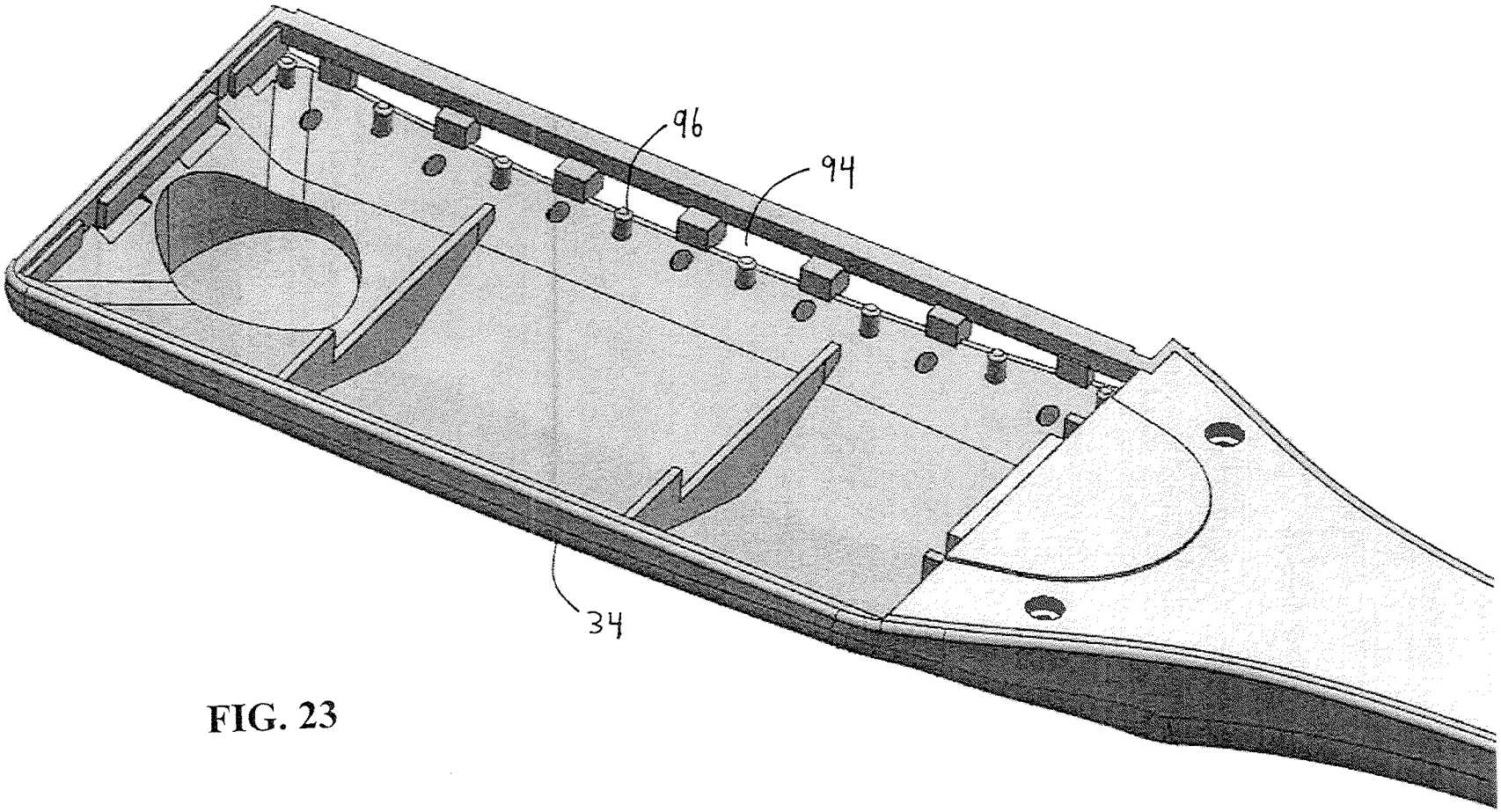
FIG. 23 is a bottom perspective view of a housing portion of the hair treatment iron of FIG. 18A.
Figure 24:
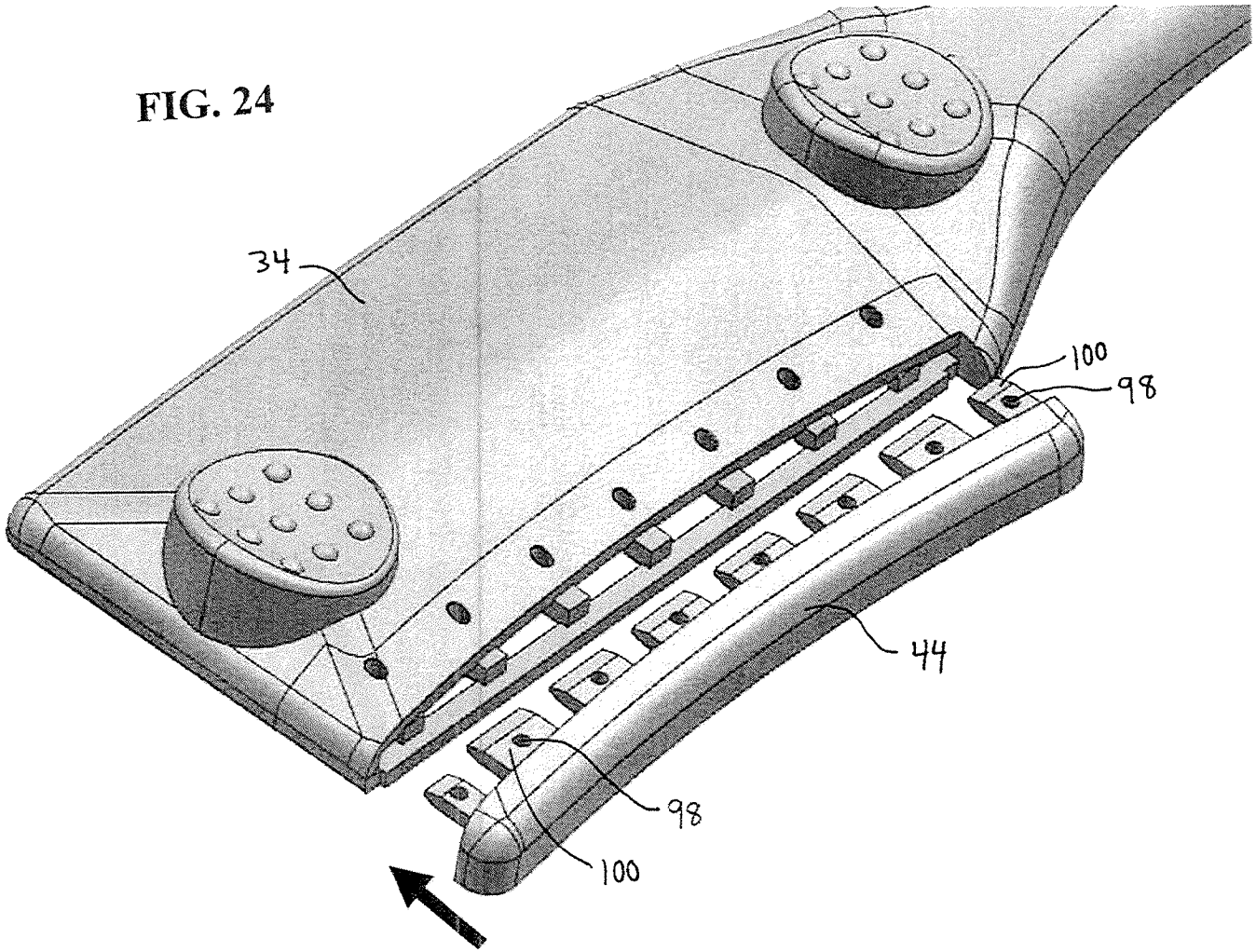
FIG. 24 is a top perspective view of the housing portion shown in FIG. 23 and a seal.

Housing portion 34, without second plate 14 or seal 44, is shown in FIGS. 23 and 24. Housing apertures 94 are included in the side of housing portion 34, to receive portions of seal 44. Rods 96 extend from the surface of housing portion 34, proximate to housing apertures 94. These rods 96 are designed to be inserted into seal apertures 98, which are shown in FIG. 24. These seal apertures 98 are located in seal projections 100.

Figure 25:
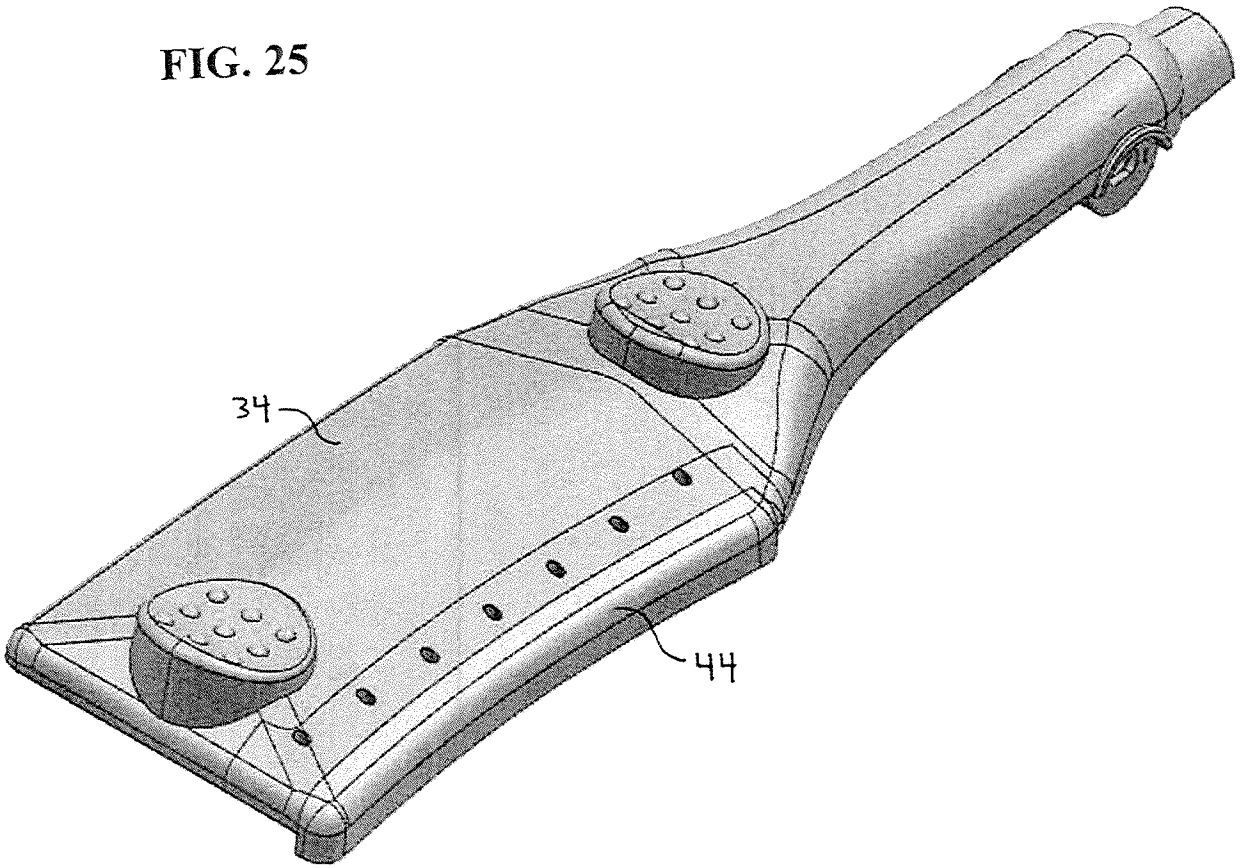
FIG. 25 is a top perspective view of the housing portion and seal shown in FIG. 24 after assembly.
Figure 26B:
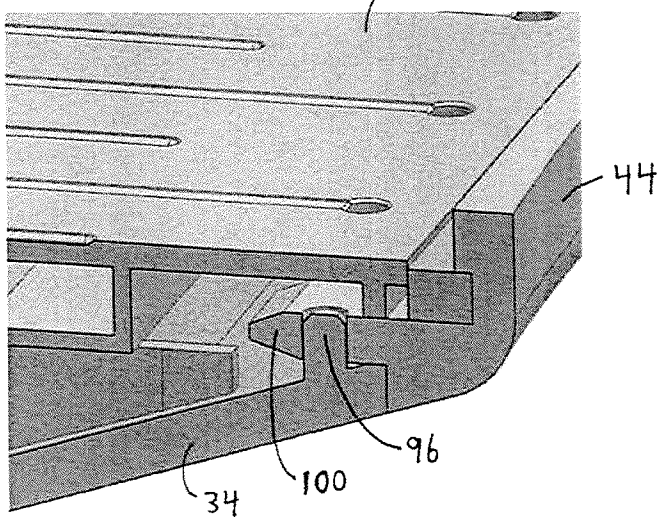
FIG. 26B is a cross-sectional view of the assembled components of FIG. 26A taken along line I.
Figure 26A:
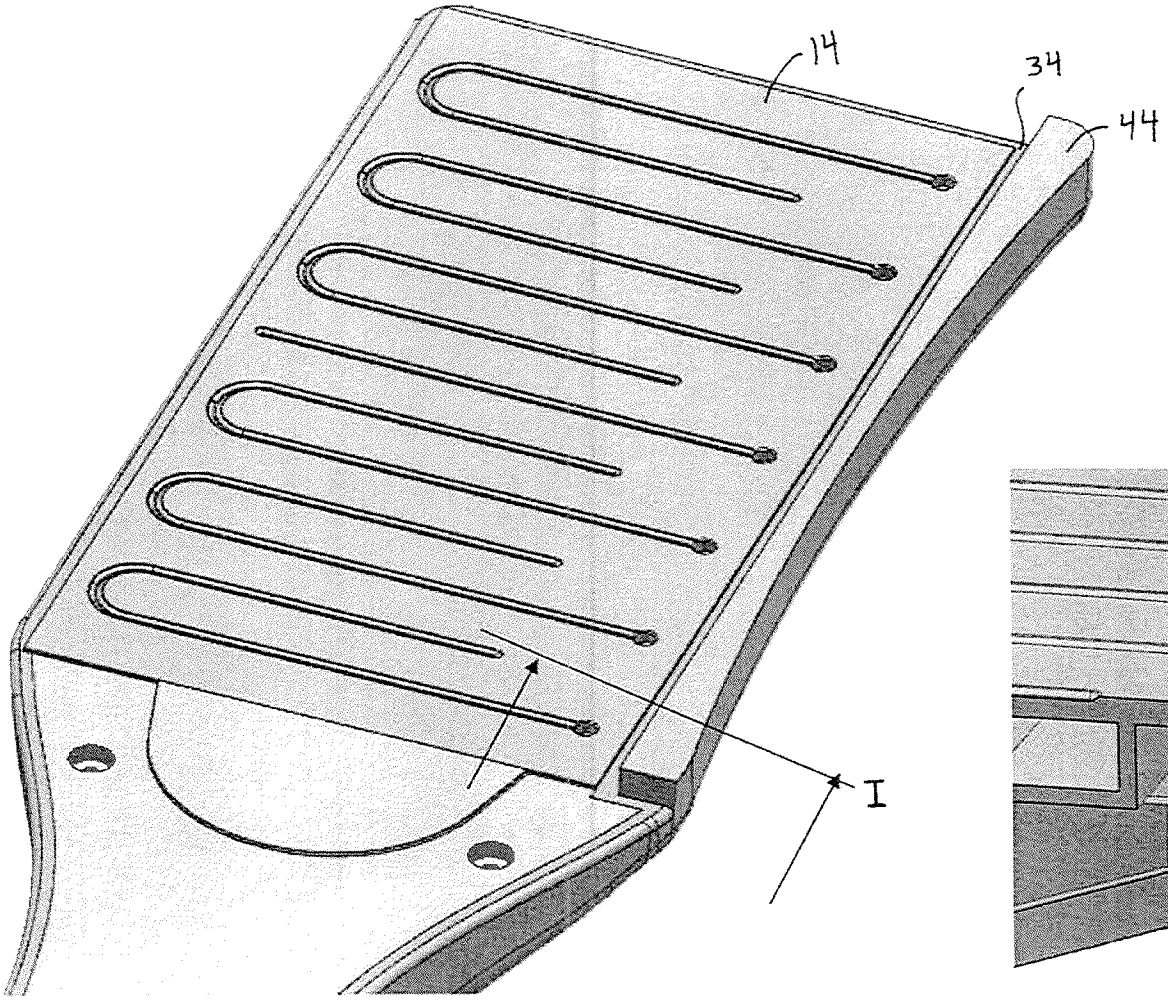
FIG. 26A is a bottom perspective view of a plate and the housing portion and seal shown in FIG. 25 after assembly.

To affix the seal 44 onto housing portion 34, seal projections 100 are inserted into housing apertures 94, and rods 96 of housing portion 34 are inserted into seal apertures 98. The housing portion 34 after seal 44 is affixed is shown in FIG. 25 and FIGS. 26A-26B. FIG. 26B shows seal projection 100 surrounding rod 96 of housing portion 34. The frictional force between seal 44 and housing portion 34 holds the seal in place after it is affixed to housing portion 34 as described. Seal 40 is affixed to housing portion 32 in the same manner. In other embodiments, other means of attaching the seals to the housing may be used, such as adhesives or snap-fit connections. The seal 44 may be made from silicone, but other materials, such as plastics or rubber materials, may also be used. The housing portion 34 may be made from a material which is heat resistant, such as a heat resistant hard plastic.

Figure 27:
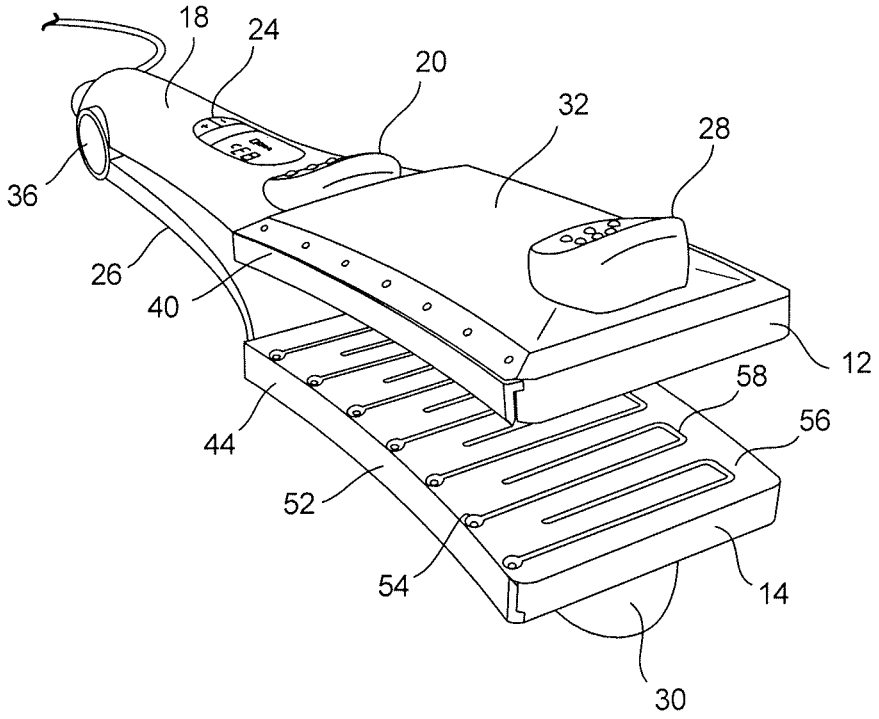
FIG. 27 is a top perspective view of a sixth embodiment of the hair treatment iron of the present invention.
Figure 28:
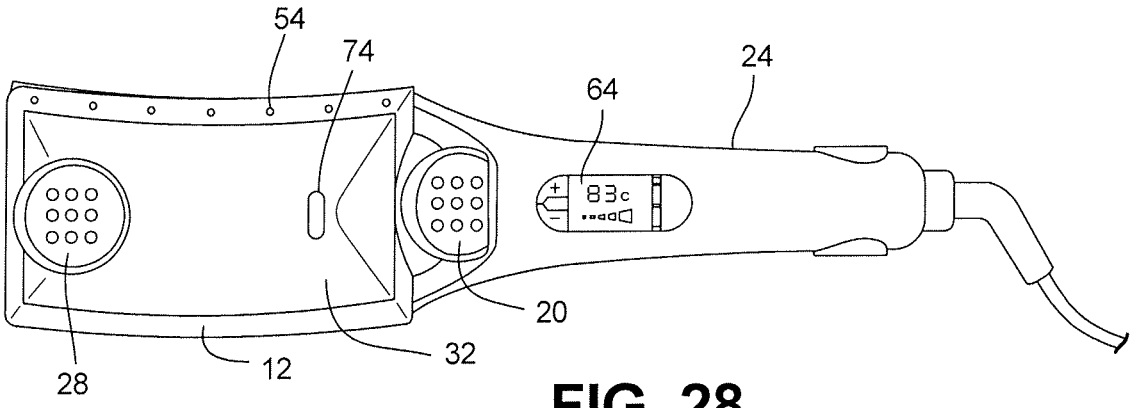
FIG. 28 is a top view of the hair treatment iron of FIG. 18.

A sixth embodiment of hair treatment iron 10 in accordance with the present invention is shown in FIGS. 27-28. Unlike the hair treatment irons of the previous embodiments, the plates 12, 14 shown in FIG. 18 are curved in the longitudinal direction, in order to correspond to the shape of a user's head. The curved shape of plates 12, 14, allow the plates to closely approach a user's scalp along the length of the plates, even though the proximal edges 52 of seals 40, 44 have a straight edge. The hair treatment iron of FIGS. 27-28 also differs from the previous embodiments in that handle portions 24, 26, as shown in FIG. 28, are indirectly connected to housing portions 32, 34, rather than being directly connected. First handle portion 24 is directly connected to first plate 12, and first housing portion 32 is attached to first plate 12. Second handle portion 26 is directly connected to second plate 14, and second housing portion 34 is attached to second plate 14. Finally, time indicator 74 shown in FIG. 28 is located on first housing portion 32, whereas in the embodiment shown in FIG. 11, the time indicator 74 is located on handle 18.

Figure 29A:
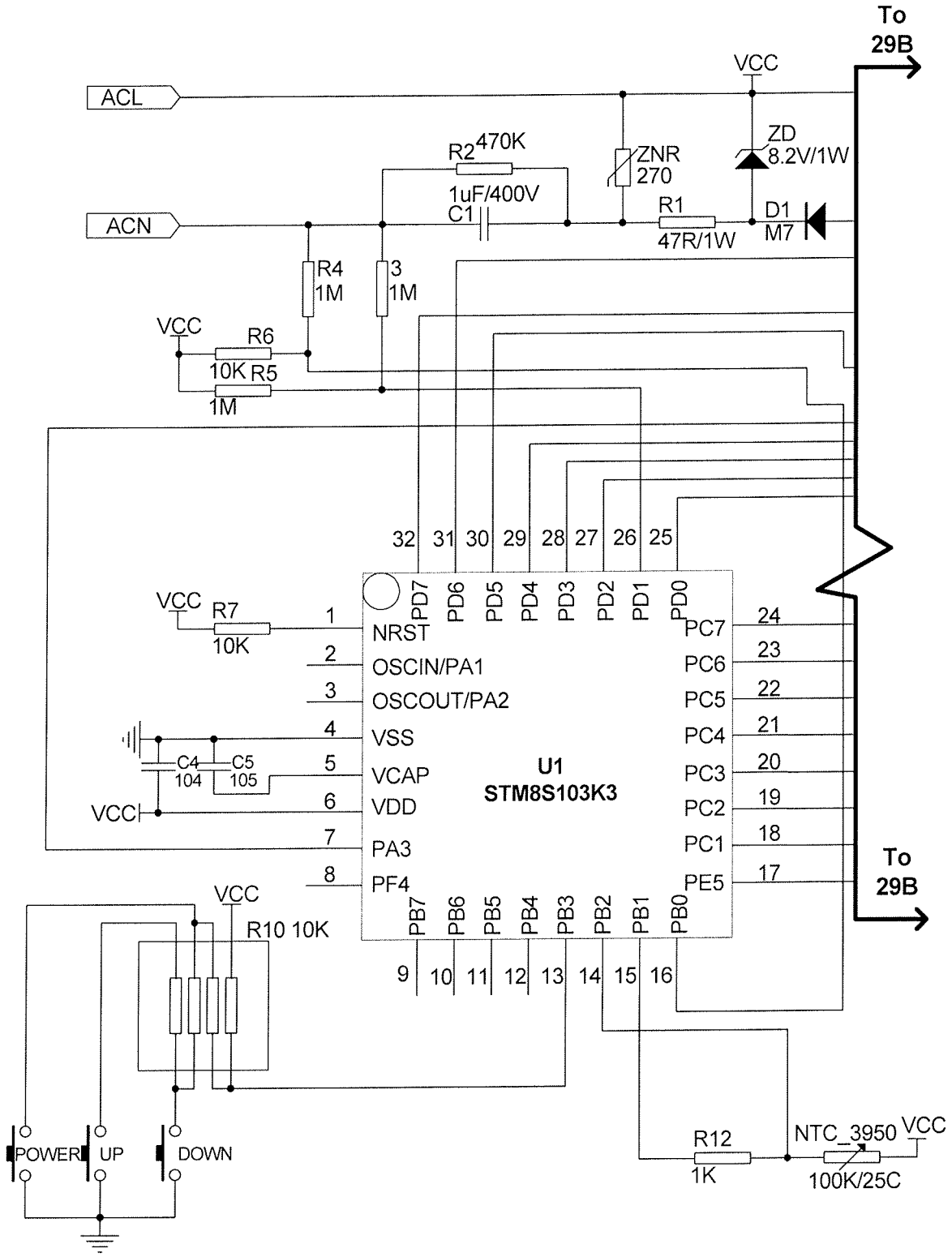
FIGS. 29A-29B is a schematic wiring diagram of a hair treatment iron made in accordance with the present invention.
Figure 29B:
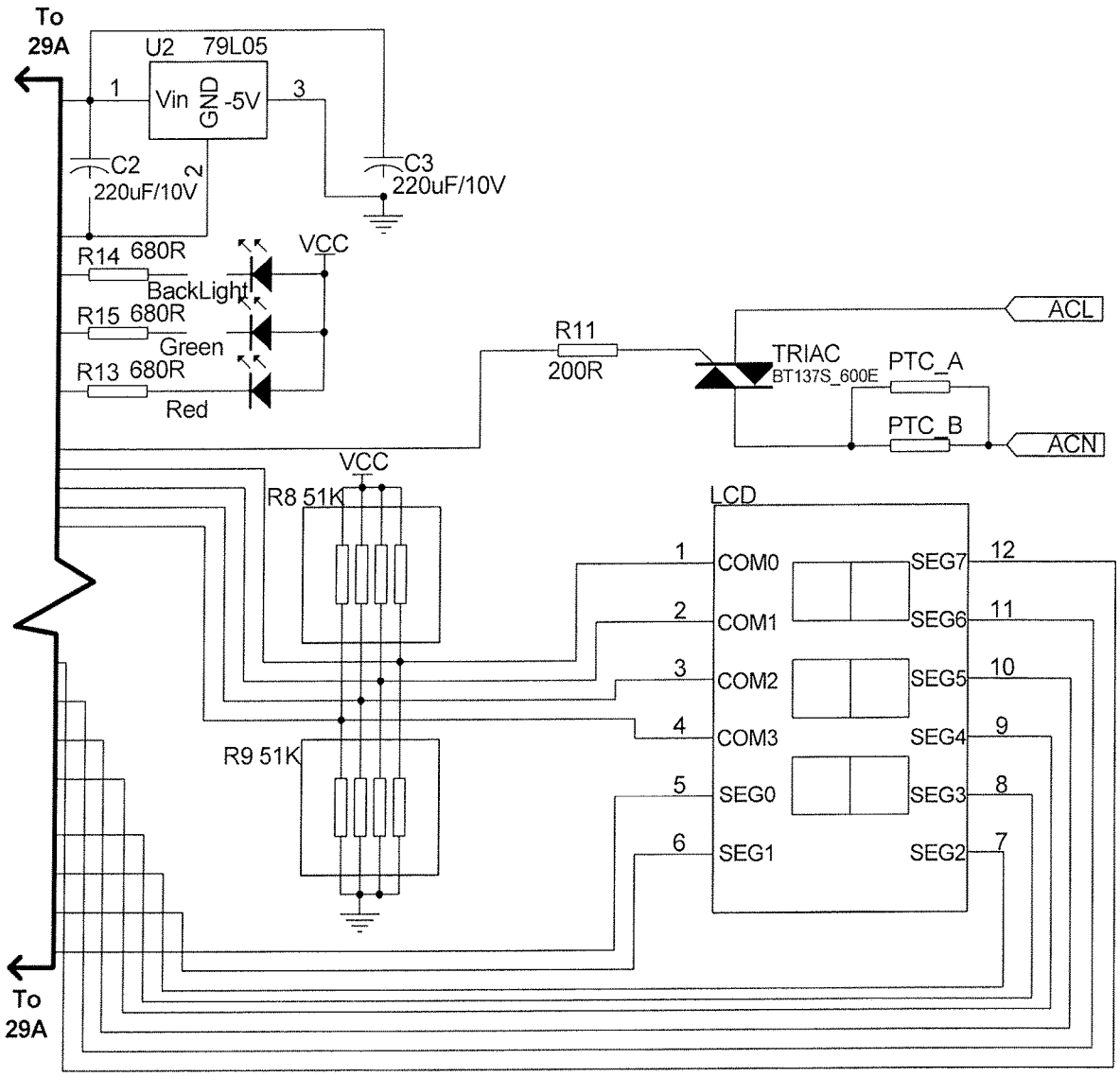

FIGS. 29A-29B is a schematic wiring diagram of a hair treatment iron made in accordance with the present invention. However, the wiring of a hair treatment iron of the present invention may be accomplished using other schematic wiring diagrams, and therefore the wiring diagram of FIGS. 29A-29B is included as an example only.

To use the hair treatment iron 10 of the present invention, the colorist applies hair color product and foils to the client's hair, such that strands of hair are enclosed in foil packets. An example of a hair color product that may be used with the hair treatment iron, without the use of bleach, is a high lift tint in the range of level 10 to 12, which is mixed with 20 to 40 volume peroxide depending on the strength needed. After the strands of a client's hair which are to be highlighted are enclosed in foil packets, the hair treatment iron 10 is closed on a foil packet of hair. The hair treatment iron 10 is oriented such that the foil packet of hair is able to lie flat between the plates 12, 14, and the seals 40, 44 are next to the client's scalp.

When the hair treatment iron 10 is closed on a foil packet of hair, the foil packet is pressed between the plates 12, 14, similar to the way in which hair is pressed by a curling iron or straightening iron. The colorist may close the hair treatment iron 10 by applying pressure to the handle finger grips 20, 22 with one hand. The colorist may use his or her other hand to apply pressure to housing finger grips 28, 30, thereby controlling the pressure on the foil packet of hair between the plates 12, 14. Preferably, the pressure on the foil packet of hair should be great enough to efficiently transmit heat to the entire packet of hair, but should not be great enough to cause hair color product to be squeezed out of the foil packet of hair.

Preferably, the hair treatment iron 10 is closed on a foil-covered section of hair for a measured amount of time, wherein the amount of time is selected based on the desired result and based on the length of time the hair has been in contact with the hair color product. As discussed above, the desired amount of time may be programmed into the hair treatment iron. Each foil packet of hair is typically held between the plates 12, 14 of the hair treatment iron 10 for less than one minute. After the first foil packet of hair has been pressed between the plates 12, 14 for the desired amount of time, the colorist stops applying pressure to finger grips 20, 22, 28, 30 and allows the plates 12, 14 to separate, thereby releasing the first foil packet of hair. Because of the speed in which each section of hair may be treated with the hair treatment iron, an entire head of hair may be processed in less than 10 minutes. Depending on the thickness of the hair and the amount of lightening of color desired, in some instances an entire head of hair may be processed in less than 5 minutes.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method of highlighting or lightening hair, comprising:

providing a hair iron comprising: a first housing portion having a first plate and a second housing portion having a second plate, the first and second housing portions being pivotably coupled to form a clamp, wherein each of the first and second plates provides a heating element operatively coupled thereto to heat the first and second plates, and at least one of the first and second plates provides a plurality of channels terminating in venting passages, wherein the hair iron does not provide means for generating or dispensing steam, and wherein each of the first and second housing portions has a barrier wall along a proximal edge thereof such that when the first and second housing portions are pivoted towards one another into a closed state the barrier walls contact one another in a sealing manner;

applying an oxidative hair dye or bleach to a first section of the hair;

applying a first foil to the first section of the hair to create a first foil-covered hair section;

transmitting heat to the first foil-covered hair section by placing the first foil-covered hair section between the first and second plates with the barrier walls arranged facing the user's scalp and forcing the hair iron into the closed state for a first unit of time, wherein during the transmitting step, steam emanates from the first foil-covered hair section and the barrier walls prevent the steam from flowing to and contacting the user's scalp and the steam is directed through the channels and into the venting passages; and removing the first foil and oxidative hair dye or bleach from the first foil-covered hair section to create a first highlighted or lightened section of hair having a first highlighted or lightened tone.

2. The method of claim 1, wherein the venting passages pass through the first plate along a proximal edge of the first plate.

3. The method of claim 1, wherein a proximal edge of the first plate and a proximal edge of the second plate are curved.

4. The method of claim 1, wherein the proximal edge of the first housing portion and the proximal edge of the second housing portion are curved.

5. The method of claim 1, wherein an edge of each barrier wall is curved.

6. The method of claim 1, wherein the venting passages pass through the at least one of the first and second plates at an angle.

7. The method of claim 1, wherein the hair iron further comprising a handle including a first handle portion and a second handle portion, wherein the first handle portion is connected to the first housing portion and the second handle portion is connected to the second housing portion.

8. The method of claim 7, wherein the hair iron further comprises a pivot and an alignment bracket located between the first handle portion and the second handle portion.

9. The method of claim 1, wherein the first unit of time is less than one minute.

10. The method of claim 1, further comprising:

applying the oxidative hair dye or bleach to a second section of the hair;

applying a second foil to the second section of hair to create a second foil-covered hair section;

transmitting heat to the second foil-covered hair section by placing the second foil-covered hair section between the first plate and the second plate of the hair iron for a second unit of time; and removing the second foil and the oxidative hair dye or bleach from the second foil-covered hair section to create a second highlighted or lightened section of hair having a second highlighted or lightened tone.

11. The method of claim 10, wherein the second unit of time is less than one minute.

12. The method of claim 10, wherein the first unit of time and the second unit of time are each less than one minute.

13. The method of claim 10, wherein the first unit of time is substantially the same as the second unit of time.

14. The method of claim 10, wherein the second highlighted or lightened tone is substantially the same as the first highlighted or lightened tone.

15. The method of claim 10, wherein the second unit of time is longer than the first unit of time.

16. The method of claim 15, wherein the second highlighted or lightened tone is substantially the same as the first highlighted or lightened tone.

17. The method of claim 1, wherein the hair is previously colored hair, and the first highlighted or lightened tone is lighter than a tone of the first section of the hair prior to application of the oxidative hair dye or bleach by greater than one level.

18. A method of highlighting or lightening hair comprising:

providing a hair iron comprising: a first housing portion having a first plate and a second housing portion having a second plate, the first and second housing portions being pivotably coupled to form a clamp, wherein each of the first and second plates provides a heating element operatively coupled thereto to heat the first and second plates, and at least one of the first and second plates provides a plurality of venting passages extending entirely through the corresponding plate(s) at an acute angle, wherein the hair iron does not provide means for generating or dispensing steam, and wherein each of the first and second housing portions has a curved proximal edge, applying an oxidative hair dye or bleach to a first section of hair of a plurality of sections of hair;

applying a first foil to the first section of hair to create a first foil-covered hair section;

applying the oxidative hair dye or bleach to a second section of hair of the plurality of sections of hair;

applying a second foil to the second section of hair to create a second foil-covered hair section;

transmitting heat to the first foil-covered hair section by placing the first foil-covered hair section between the first and second plates with the proximal edges arranged facing the user's scalp and forcing the hair iron into a closed state for a first unit of time, wherein during the transmitting step, steam emanates from the first foil-covered hair section and the steam is directed into the venting passages;

transmitting heat to the second foil-covered hair section by placing the second foil-covered hair section between the first and second plates with the proximal edges arranged facing the user's scalp and forcing the hair iron into the closed state for a second unit of time, wherein during the transmitting step, steam emanates from the second foil-covered hair section and the steam is directed into the venting passages; and removing the first and second foils and the oxidative hair dye or bleach from the first and second foil-covered hair sections to create a first highlighted or lightened section of hair and a second highlighted or lightened section of hair, wherein the first highlighted or lightened section of hair has a first highlighted or lightened tone and the second highlighted or lightened section of hair has a second highlighted or lightened tone.

19. The method of claim 18, wherein the hair is previously colored hair, and wherein the first highlighted or lightened tone is lighter than a tone of the first section of hair prior to application of the oxidative hair dye or bleach by greater than one level, and the second highlighted or lightened tone is lighter than a tone of the second section of hair prior to application of the oxidative hair dye or bleach by greater than one level.

20. The method of claim 1, wherein there is a space between the first plate and the second plate of the hair iron when the hair iron is in the closed state.

21. The method of claim 18, wherein there is a space between the first plate and the second plate of the hair iron when the hair iron is in the closed state.

* * * * *